US010603819B2

(12) United States Patent
Sergyeyenko et al.

(10) Patent No.: US 10,603,819 B2
(45) Date of Patent: Mar. 31, 2020

(54) TILE SAW

(71) Applicant: BLACK & DECKER INC., New Britain, CT (US)

(72) Inventors: Oleksiy P. Sergyeyenko, Baldwin, MD (US); Eric Prendeville, Lutherville, MD (US); Tyler M. Knight, Ellicott City, MD (US); Jason C. McRoberts, Red Lion, PA (US); Brent A. Kuehne, Red Lion, PA (US); Nicholas A. Mondich, Baltimore, MD (US); Steven McClaskey, N. Las Vegas, NV (US); Frederick R. Bean, Finksburg, MD (US); Bryan Slocum, Bel Air, MD (US); Sean Bailey, Towson, MD (US); Emmanuel Gloria, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 0 days.

(21) Appl. No.: 15/243,172

(22) Filed: Aug. 22, 2016

(65) Prior Publication Data

US 2017/0173824 A1 Jun. 22, 2017

Related U.S. Application Data

(60) Provisional application No. 62/325,783, filed on Apr. 21, 2016, provisional application No. 62/268,092, filed on Dec. 16, 2015.

(51) Int. Cl.

| | |
|---|---|
| ***B28D 1/04*** | (2006.01) |
| ***B28D 7/02*** | (2006.01) |
| ***B28D 7/04*** | (2006.01) |

(52) U.S. Cl.
CPC ..... *B28D 1/047* (2013.01); *B28D 7/02* (2013.01); *B28D 7/04* (2013.01)

(58) Field of Classification Search
CPC ..... B28D 1/04; B28D 1/047; B28D 7/04
See application file for complete search history.

(56) References Cited

U.S. PATENT DOCUMENTS

| | | | |
|---|---|---|---|
| 582,096 | A | 5/1897 | Rominger |
| 1,326,202 | A | 12/1919 | Judelshon |
| 1,426,496 | A | 8/1922 | Norris |

(Continued)

FOREIGN PATENT DOCUMENTS

| | | |
|---|---|---|
| CN | 203371664 | 1/2014 |
| EP | 1424160 | 6/2004 |

(Continued)

OTHER PUBLICATIONS

EP Search Report dated Apr. 7, 2017 for EP Application No. 16202901.
Prior Art - Picture of Table Saw.

*Primary Examiner* — Timothy V Eley
(74) *Attorney, Agent, or Firm* — Stephen R. Valancius

(57) ABSTRACT

A cutting device including a stand and a saw supported by the stand. The saw includes a motor and a blade rotatably driven by the motor. A pair of rails is supported by the stand. A tray is configured to support an object to be cut on an upper surface and including a roller assembly on a lower surface. The tray is slidable along the pair of rails towards and away from the blade. At least one of the rails is disposed over a basin configured to hold water.

19 Claims, 45 Drawing Sheets

(56) References Cited

U.S. PATENT DOCUMENTS

| | | | | |
|---|---|---|---|---|
| 1,938,777 | A | 12/1933 | Nenninger | |
| 2,000,667 | A | 5/1935 | Osterholm | |
| 2,051,333 | A | 8/1936 | Flindt | |
| 2,236,854 | A | 4/1941 | Ocenasek | |
| 2,444,598 | A | 7/1948 | Eyles et al. | |
| 2,507,437 | A | 5/1950 | Eserkaln | |
| 2,990,862 | A | 7/1961 | Ruben | |
| 3,142,521 | A | 7/1964 | Petroff | |
| 3,848,502 | A | 11/1974 | O'Neill | |
| 4,248,116 | A | 2/1981 | Vitols | |
| 4,422,396 | A | 12/1983 | Szostak et al. | |
| 4,976,251 | A | 12/1990 | Smith | |
| 5,231,906 | A | 8/1993 | Kogej | |
| RE35,666 | E * | 11/1997 | Smith | B23D 47/025 125/13.01 |
| D400,896 | S | 11/1998 | Hepworth | |
| 5,875,698 | A | 3/1999 | Ceroll et al. | |
| D427,213 | S | 6/2000 | Chen | |
| 6,244,149 | B1 | 6/2001 | Ceroll et al. | |
| 6,253,757 | B1 | 7/2001 | Benson | |
| 6,347,624 | B1 | 2/2002 | Smith et al. | |
| 6,427,677 | B1 | 8/2002 | O'Banion et al. | |
| 6,453,786 | B1 | 9/2002 | Ceroll et al. | |
| 6,494,198 | B1 | 12/2002 | Chen | |
| D475,267 | S | 6/2003 | Bradfield et al. | |
| 6,595,096 | B2 | 7/2003 | Ceroll et al. | |
| 6,752,140 | B1 | 6/2004 | Fuhrman et al. | |
| D492,706 | S | 7/2004 | Hepworth | |
| 6,782,882 | B1 | 8/2004 | Chen | |
| 6,820,524 | B1 | 11/2004 | Ceroll et al. | |
| 6,845,768 | B2 | 1/2005 | O'Banion et al. | |
| 6,880,543 | B2 | 4/2005 | Bradfield | |
| D508,928 | S | 8/2005 | Chen | |
| 6,932,073 | B2 | 8/2005 | Zhang | |
| D510,096 | S | 9/2005 | Wu | |
| 7,084,779 | B2 | 8/2006 | Uneyama | |
| D549,748 | S | 8/2007 | Skillings et al. | |
| 7,387,120 | B2 | 6/2008 | O'Banion et al. | |
| D595,470 | S | 6/2009 | Albert et al. | |
| D603,685 | S | 11/2009 | Jackson | |
| 7,644,645 | B2 | 1/2010 | Gass et al. | |
| 7,819,111 | B2 | 10/2010 | Wise | |
| 7,823,575 | B2 | 11/2010 | O'Banion et al. | |
| 8,096,519 | B2 | 1/2012 | Tam et al. | |
| 8,381,626 | B2 | 2/2013 | Marsic et al. | |
| 8,522,658 | B2 | 9/2013 | Frolov | |
| 8,677,987 | B2 | 3/2014 | Chaganos | |
| 2003/0131703 | A1 | 7/2003 | Gass et al. | |
| 2005/0000339 | A1 | 1/2005 | Chang | |
| 2005/0022645 | A1 | 2/2005 | Hepworth | |
| 2005/0204884 | A1 | 9/2005 | Huang | |
| 2008/0121081 | A1 * | 5/2008 | Cheng | B23D 59/003 83/521 |
| 2008/0289467 | A1 | 11/2008 | Skillings et al. | |
| 2009/0266350 | A1 | 10/2009 | Zhang | |
| 2009/0277315 | A1 | 11/2009 | Ipatenco et al. | |
| 2010/0180741 | A1 | 7/2010 | Gass et al. | |
| 2010/0288257 | A1 * | 11/2010 | Wei | B23D 47/025 125/13.01 |
| 2014/0216224 | A1 * | 8/2014 | Bernhardt | B28D 1/04 83/102.1 |
| 2014/0261367 | A1 | 9/2014 | Ipatenco et al. | |
| 2014/0311312 | A1 | 10/2014 | Frolov et al. | |
| 2015/0013659 | A1 | 1/2015 | Chen | |
| 2015/0367530 | A1 | 12/2015 | Vikholm et al. | |

FOREIGN PATENT DOCUMENTS

| | | |
|---|---|---|
| EP | 2113354 | 11/2009 |
| FR | 2514278 A1 | 4/1983 |
| FR | 2770162 | 4/1999 |
| GB | 691737 | 5/1953 |
| GB | 2134424 | 8/1984 |
| RU | 2068776 | 11/1996 |

* cited by examiner

TILE SAW

CROSS-REFERENCE TO RELATED APPLICATIONS

This application claims the benefit of U.S. Provisional Application No. 62/325,783 filed on Apr. 21, 2016, entitled Tile Saw; and U.S. Provisional Application No. 62/268,092 filed on Dec. 16, 2015, entitled Tile Saw. The entire contents of U.S. Provisional Application No. 62/325,783 and U.S. Provisional Application No. 62/268,092 are incorporated herein by reference.

FIELD OF THE INVENTION

The present invention relates to a power tool, particularly a saw, particularly a tile saw.

BACKGROUND

There are various existing saws, including tile saws. It is desired to provide an improved tile saw.

SUMMARY

According to one aspect, there is an exemplary embodiment of a cutting device including a stand. A saw is supported by the stand. The saw includes a motor and a blade rotatably driven by the motor. A pair of rails is supported by the stand. The cutting device further includes a tray configured to support an object to be cut on an upper surface and including a roller assembly on a lower surface, the tray being slidable along the pair of rails towards and away from the blade. At least one of the rails is disposed over a basin configured to hold water.

A center of the saw blade may be disposed below the tray.

The roller assembly may include a first assembly including a plurality of rollers and a second assembly including a plurality of rollers.

The assembly may include rollers above and below at least one rail.

The second assembly may include rollers only above the pair of rails.

According to another exemplary embodiment, there is a cutting device including a stand. A saw is supported by the stand. The saw includes a motor and a blade rotatably driven by the motor. The cutting device further includes a tray configured to support an object to be cut on an upper surface, the tray being slidable towards and away from the blade. There is a basin configured to hold water, part of the blade rotating through the basin. A blade guard covers a portion of the blade, the blade guard comprising a first portion and a second portion, the second portion being rotatable with respect to the first portion from a covering position in which it covers a portion of the blade to an exposed position in which at least some of the covered portion is exposed. The second portion is configured to stay in the exposed position when moved there by a user.

The second portion may further include a grip configured to allow a user to move the second portion from the covered position to the exposed position.

The second portion may face the object to be cut when the object to be cut is disposed on the tray.

The second portion may cover a leading cutting edge of the blade.

The cutting machine include a table surface, the table surface including at least an upper surface of the tray.

The blade guard, including the first portion and the second portion, may be adjustable in a direction towards and away from the table surface.

The cutting device may further include a water guard covering another portion of the blade.

The water guard may be fixed to the stand.

The water guard may include a base portion and a guard portion, the base portion fixed to the stand and the guard portion extending from the base portion towards the saw blade.

According to another aspect, there is an exemplary embodiment of a cutting device which includes a stand and a saw supported by the stand. The saw includes a motor and a blade rotatably driven by the motor. A tray is configured to support an object to be cut on an upper surface of the tray, the tray being slidable towards and away from the blade. The cutting device includes basin configured to hold water, part of the blade rotating through the basin. A support projects above the upper surface of the tray to support an end of the object to be cut. The support is movable to at least two positions.

The support may be removably attached to the tray.

The support may include a support attachment and the tray includes a tray attachment, wherein the support attachment engages the tray attachment to attach the support to the tray.

The support attachment may include one of a hole and a pin and the tray attachment includes the other of a hole and a pin.

The support may include at least a first support portion and a second support portion, each configured to provide support for the object to be cut at a different location on the tray.

The support may be movable between a first position where the first support portion extends above the upper surface of the tray to support the object to be cut and a second position where the second portion extends above the upper surface of the tray to support the object to be cut.

The first support portion and the second support portion may be configured to alternatively provide support for the object to be cut.

The tray may be rotatable.

The tray may be rotatable about one of the rails.

The tray may include straight line cutting markings.

DETAILED DESCRIPTION OF EXEMPLARY EMBODIMENTS

Figure 1:
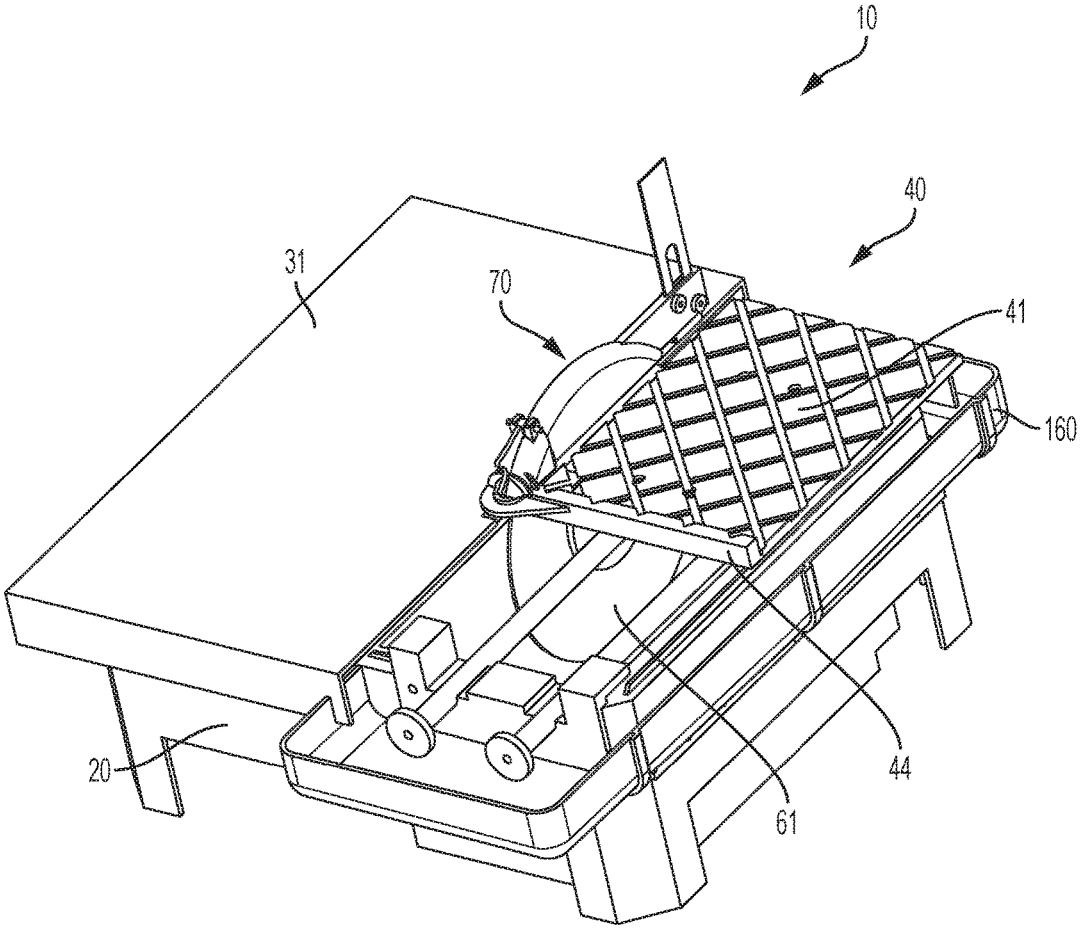
FIG. 1 illustrates a perspective view of an exemplary embodiment of a sliding table tile saw.
Figure 2:
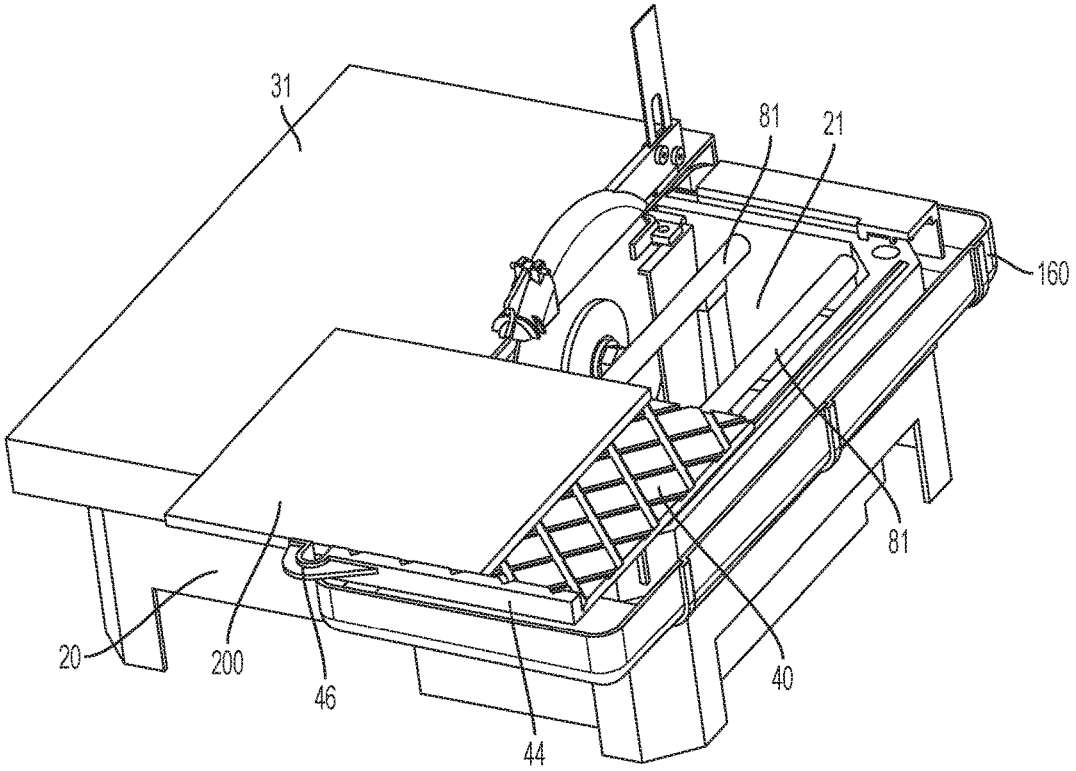
FIG. 2 is another perspective view of the exemplary embodiment of the sliding table tile saw.
Figure 3:
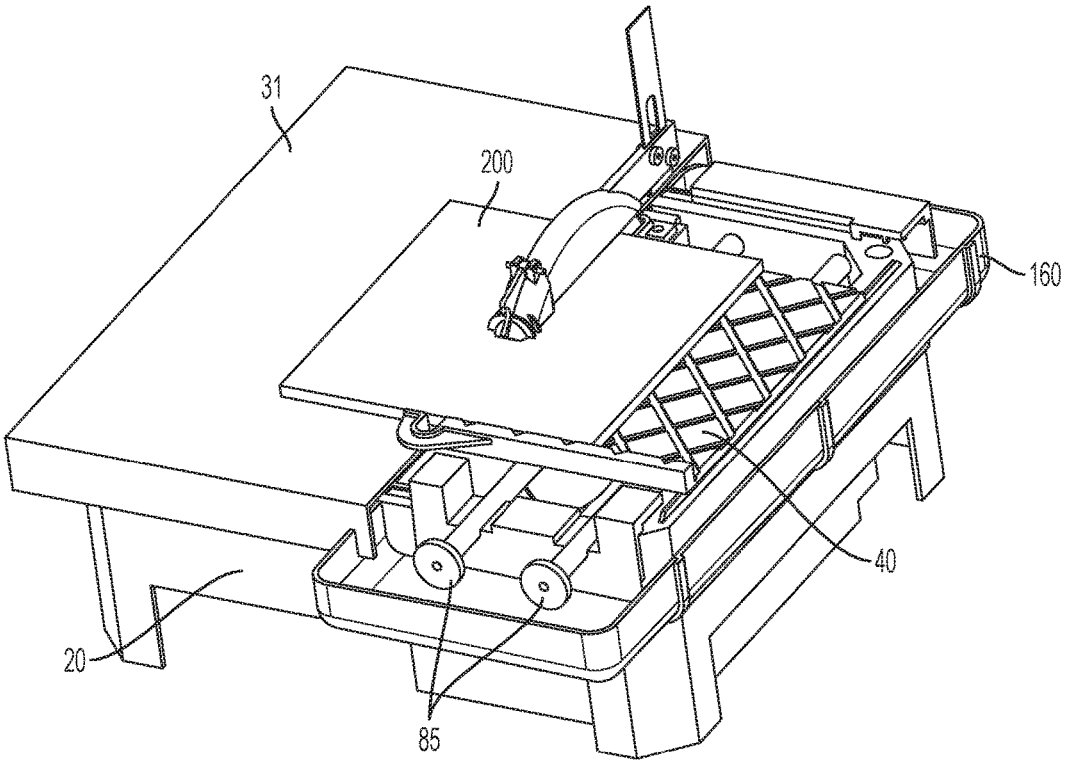
FIG. 3 is another perspective view of the exemplary embodiment of the sliding table tile saw.
Figure 4:
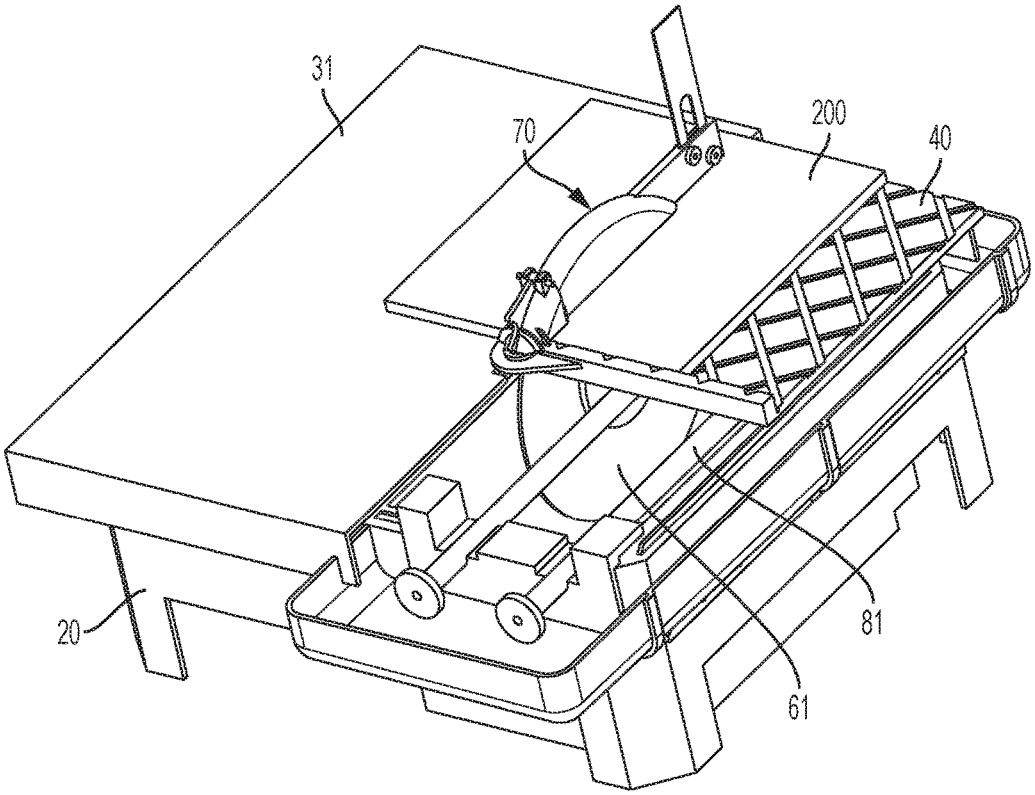
FIG. 4 is another perspective view of the exemplary embodiment of the sliding table tile saw.

FIGS. 1-4 illustrate an exemplary embodiment of a sliding table tile saw 10. The sliding table tile saw 10 has a stand 20 so that it may be placed on a table or other flat surface. Additionally, the sliding table tile saw 10 includes a table surface 30 on which object can be supported. The table surface 30 includes a fixed table surface 31 and a sliding tray 40. The sliding table tile saw 10 further includes a saw 60 with a saw blade 61. As shown, the saw blade 61 extends up from below the table surface 30 so that a portion of the blade is exposed. The sliding tray 40 can be slid to multiple positions as shown in FIGS. 2-4 along a rail assembly that will be described in further detail below.

FIGS. 2-4 illustrate an operation of the sliding table tile saw 10. As shown in FIG. 2, tile 200 is placed on the table surface 30 with the sliding tray 40 slid toward a front of the sliding table tile saw 10, which is away from the saw blade 61. As shown in FIG. 2, the tile 200 is supported by both the sliding tray 40 and the fixed table surface 31. In other embodiments, the sliding tray 40 may provide the sole support for the tile 200. That is, the fixed table surface 31 may not be present. In that event, it may be advantageous to include a holder to secure the tile 200 in place on the tray 40. The holder may be, for example, a screw clamp.

Once the tile 200 is placed on the tray 40, as shown in FIG. 2, the tray 40 is slid towards the saw blade 61 as shown in FIG. 3 so that the saw 60 begins to cut the tile 200. As shown in FIG. 4, the tray 400 slides to the end of the table to completely cut the tile 200.

Figure 5:
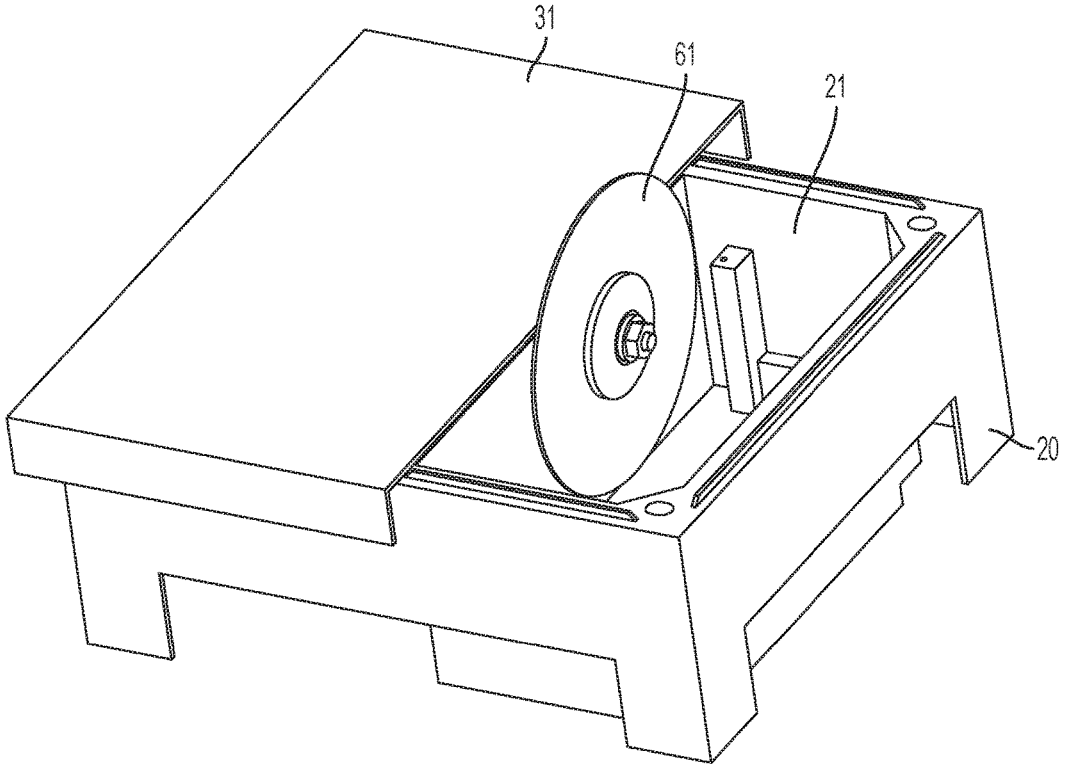
FIG. 5 is another perspective view of the exemplary embodiment of the sliding table tile saw with various parts removed.
Figure 6:
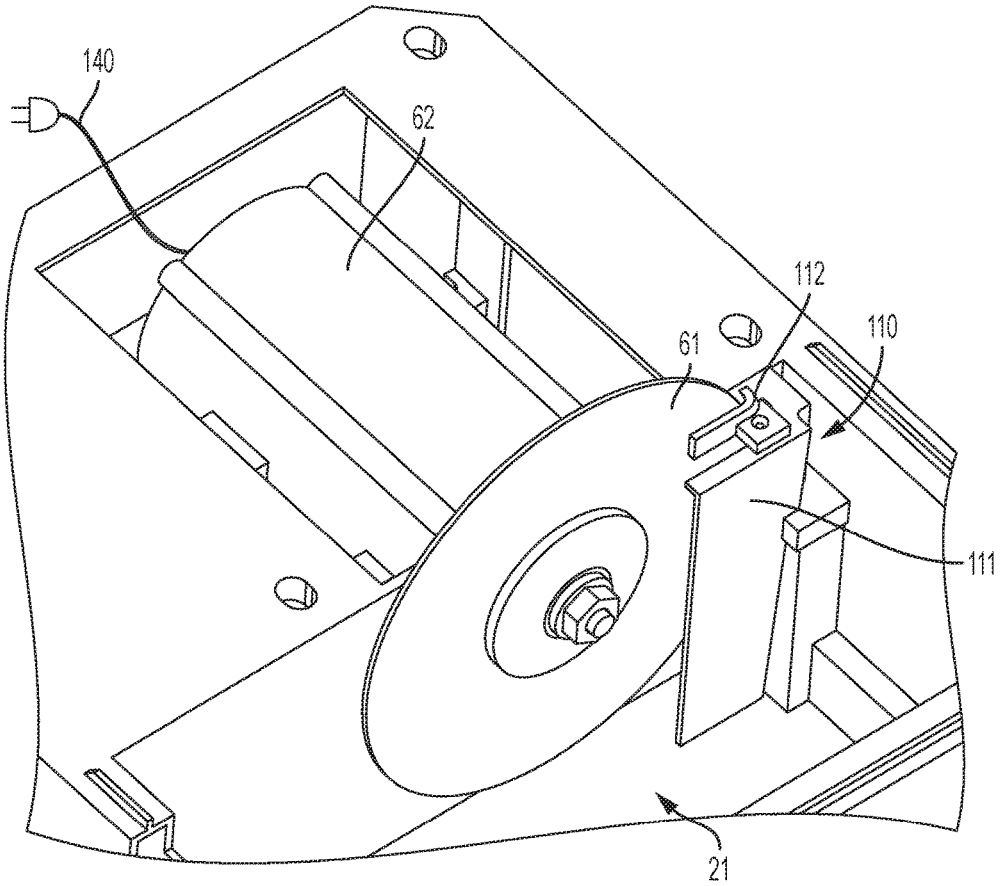
FIG. 6 is close up of the saw of the sliding table tile saw.

FIG. 5 is an illustration with various parts removed so that the saw blade 61 can be easily seen. As shown in FIG. 6, the saw blade 61 is secured in a basin 21. The basin 21 may be filled with water. As will be appreciated, as the saw blade 61 rotates, it will pass through the water in the basin 21, which will serve to clean and cool down the saw blade 61.

FIG. 6 is a close up illustration of the saw 60 with the table surface 30 removed so that the saw 60 can be seen. As shown, the saw 60 includes a motor and transmission housing 62. The motor and transmission housing 62 houses the saw motor and transmission, as is known in the art.

Figure 8:
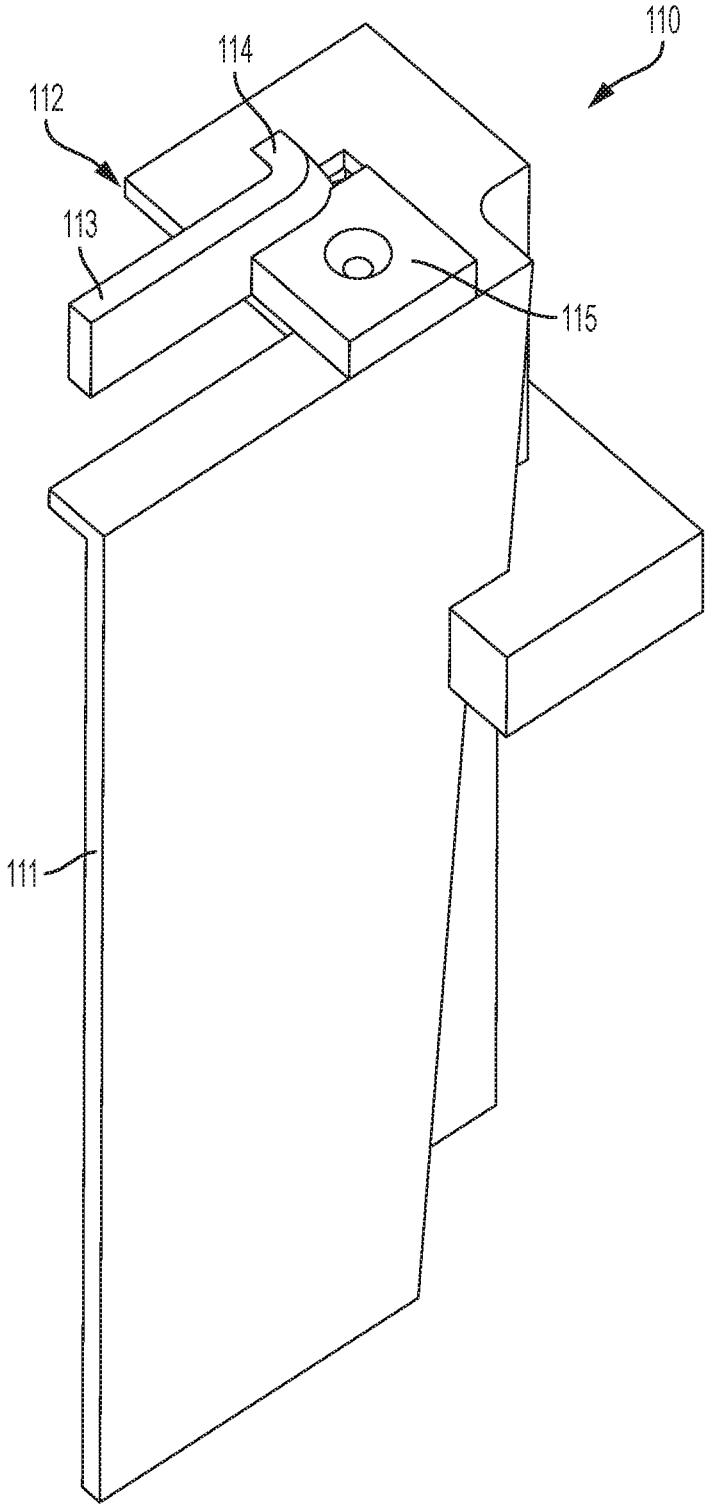
FIG. 8 is a perspective view of a blade guard according to an exemplary embodiment of the present application.

As shown in FIGS. 6 and 8, the sliding table tile saw 10 also includes a water guard 110. The water guard 110 blocks water from spraying off of the blade 61 to the work area. The water guard includes a base portion 111 and a guard portion 112 which is secured to the base portion 111. The guard portion 112 extends from the base portion 111 close to the blade 61 to cover the blade 61 where it is most prone to spray water. As shown in FIG. 6, the guard portion 112 has a side portion 113 which extends along a side of the blade 61 to block water spraying from the side of the blade 61. The guard portion 112 also has an end portion 114 which extends along a cutting face of the saw blade 61 so as to block water which may spray from the cutting face. The guard portion 112 also includes an attachment portion 115 through which the guard portion 112 may be secured to the base portion 111, such as, for example, by a screw. The base portion 111 may be integrally formed with the base 20 or may be formed separately and secured to the base 20.

Figure 7:
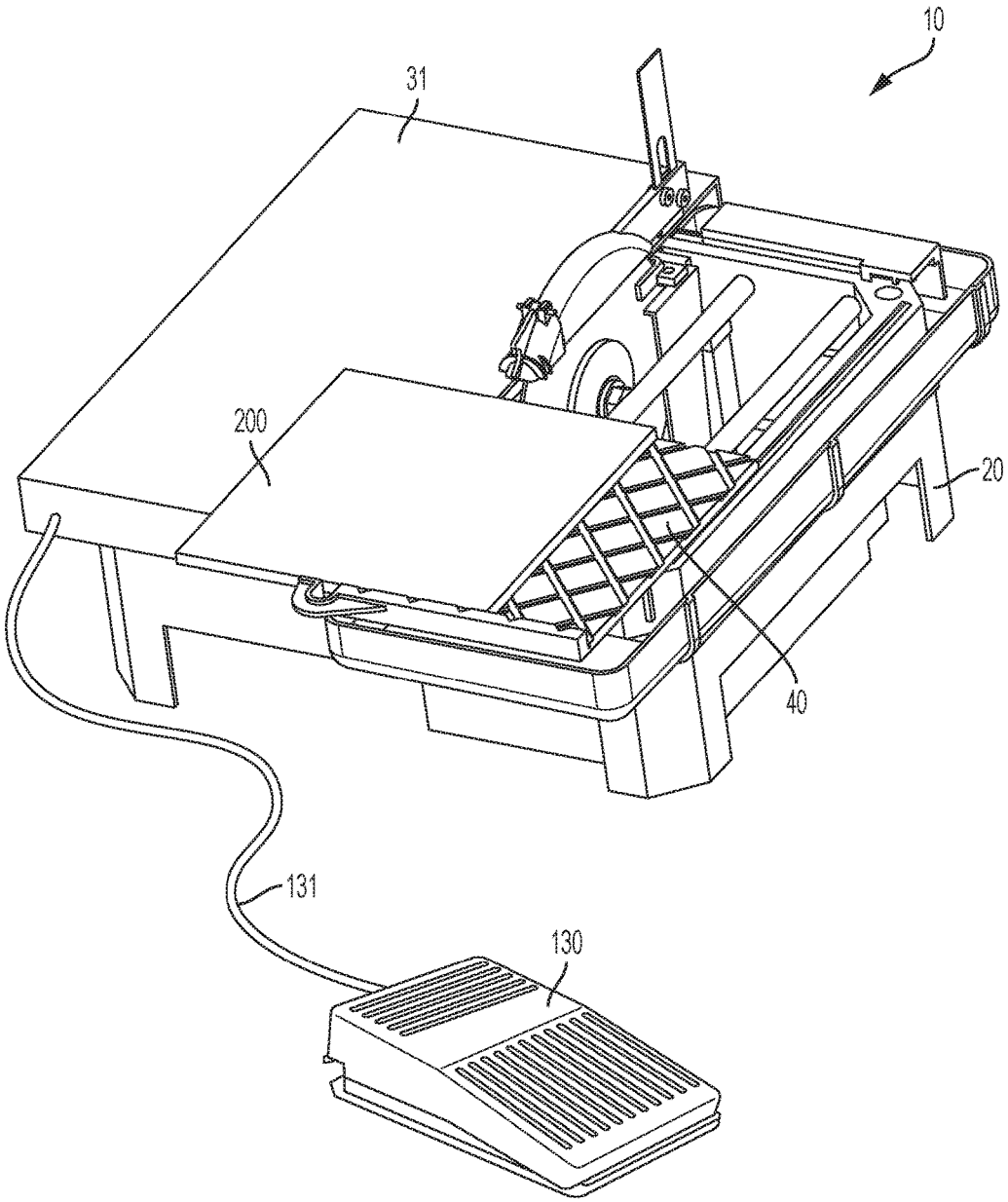
FIG. 7 is another perspective view of the exemplary embodiment of the sliding table tile saw.

The saw 60 can be turned on or off by a user. The embodiment of FIG. 7 illustrates a foot pedal switch 130. The foot pedal switch is connected to the saw 60 through a cord 131. The user can turn the saw 60 on and off by depressing the pedal 130. In this instance, the pedal 130 is momentary, meaning that the saw 60 will only stay on as long as the pedal 130 is depressed. Alternatively, a non-momentary switch may be used. The saw 60 of the exemplary embodiment is powered through a power cord 140, as shown in FIG. 6. The saw 60 may also be battery powered. For example, a power tool battery pack may be used to provide power for the saw 60.

Figure 9:
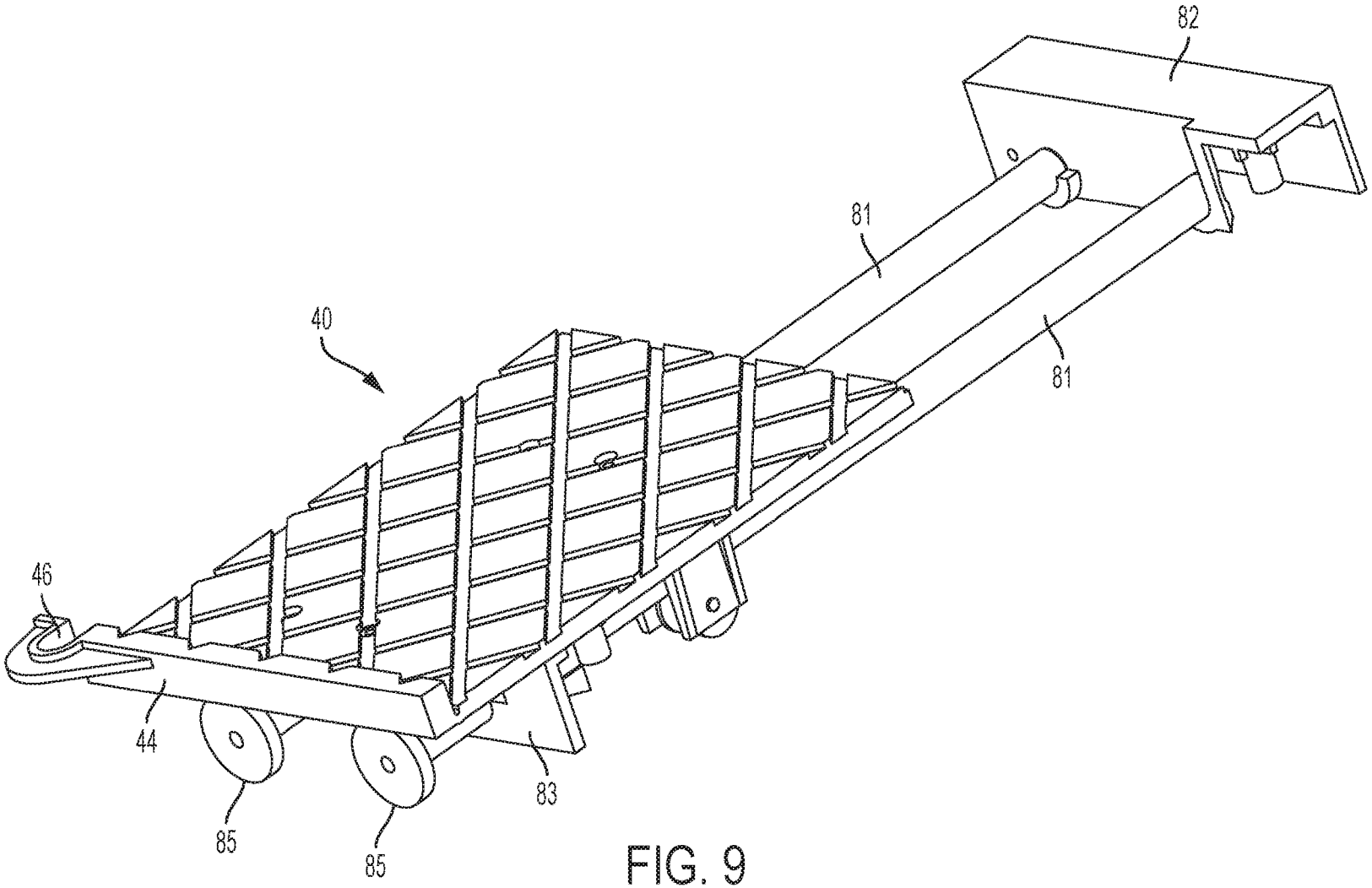
FIG. 9 is a perspective view of a sliding tray assembly according to an exemplary embodiment of the present application.
Figure 10:
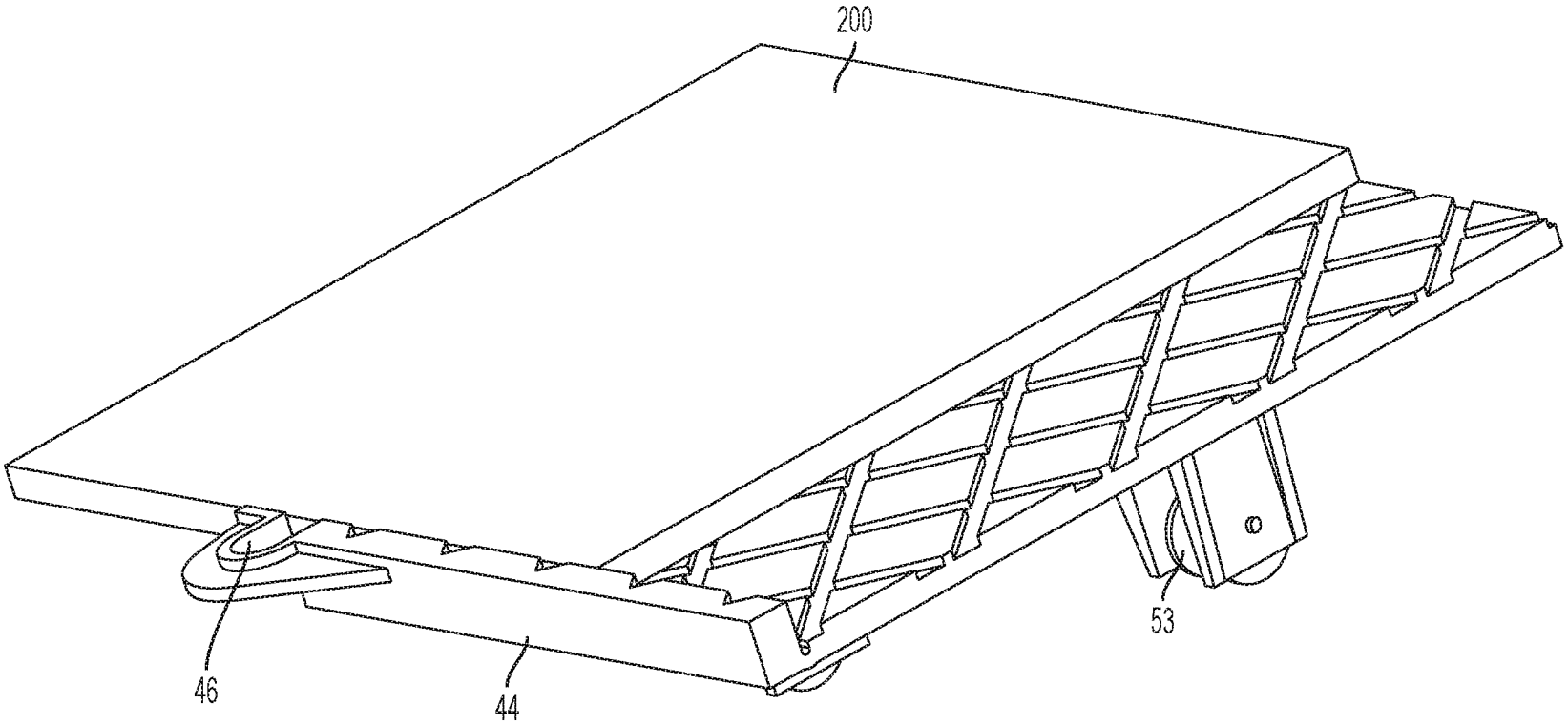
FIG. 10 is a perspective view of a sliding tray according to an exemplary embodiment of the present application.
Figure 11:
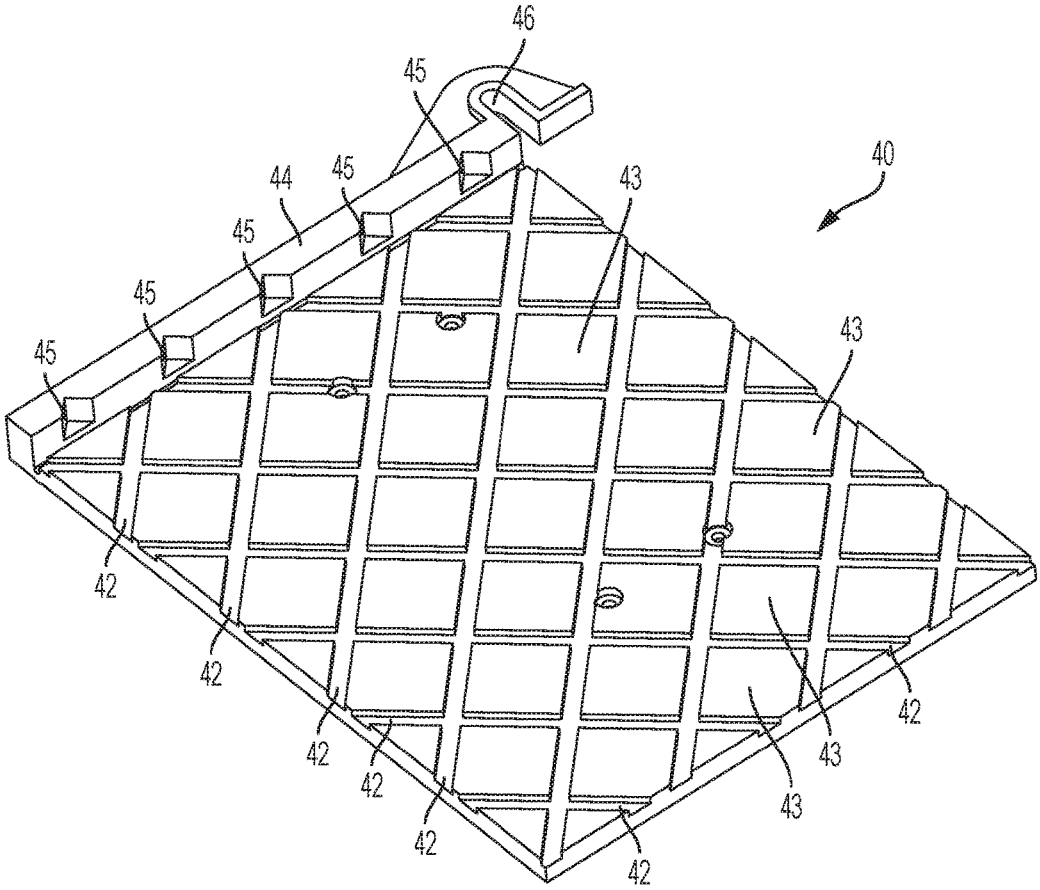
FIG. 11 is a perspective view of a tray according to an exemplary embodiment of the present application.

The tray 40 and the sliding support assembly are described in more detail with respect to FIGS. 9-13. FIG. 11 illustrates the tray 40. As shown in FIG. 11, the tray 40 includes a support surface on which tile 200 or other item to be cut may be placed. The support surface 41 includes raised portions 43 which are generally diamond shaped and channels 42 which separate the raised portions. The channels 42 all for water to flow off of the sliding tray 40 into the basin 21. The tray 40 also includes a back support 44 against which the tile 200 can be rested. This allows a user to accurately line up the tile 200. Additionally, the back support 44 includes a number of indentations 45 which can receive a corner of a tile 200. As shown in FIG. 10, the tile 200 may be placed against a length of the back support 44 so that the tile is cut into two rectangular shaped pieces, as shown in FIGS. 2-4. The indentations 45 receive a corner of the tile 200. As will be appreciated, this would result in a different cut. For example, one corner of the tile 200 could be cut off. The indentations 45 of the exemplary embodiment are generally right angle indentations to accommodate the corner of a square tile. Other shaped indentations may be included in other embodiments.

The tray 40 also includes a cut-out 46 to accommodate the saw blade 60. As shown in FIG. 4, the blade 61 will extend into the cut-out 46 when the tray 40 is completely pushed forward. The cut-out 46 allows for the tile 200 to be completely cut through.

Figure 12:
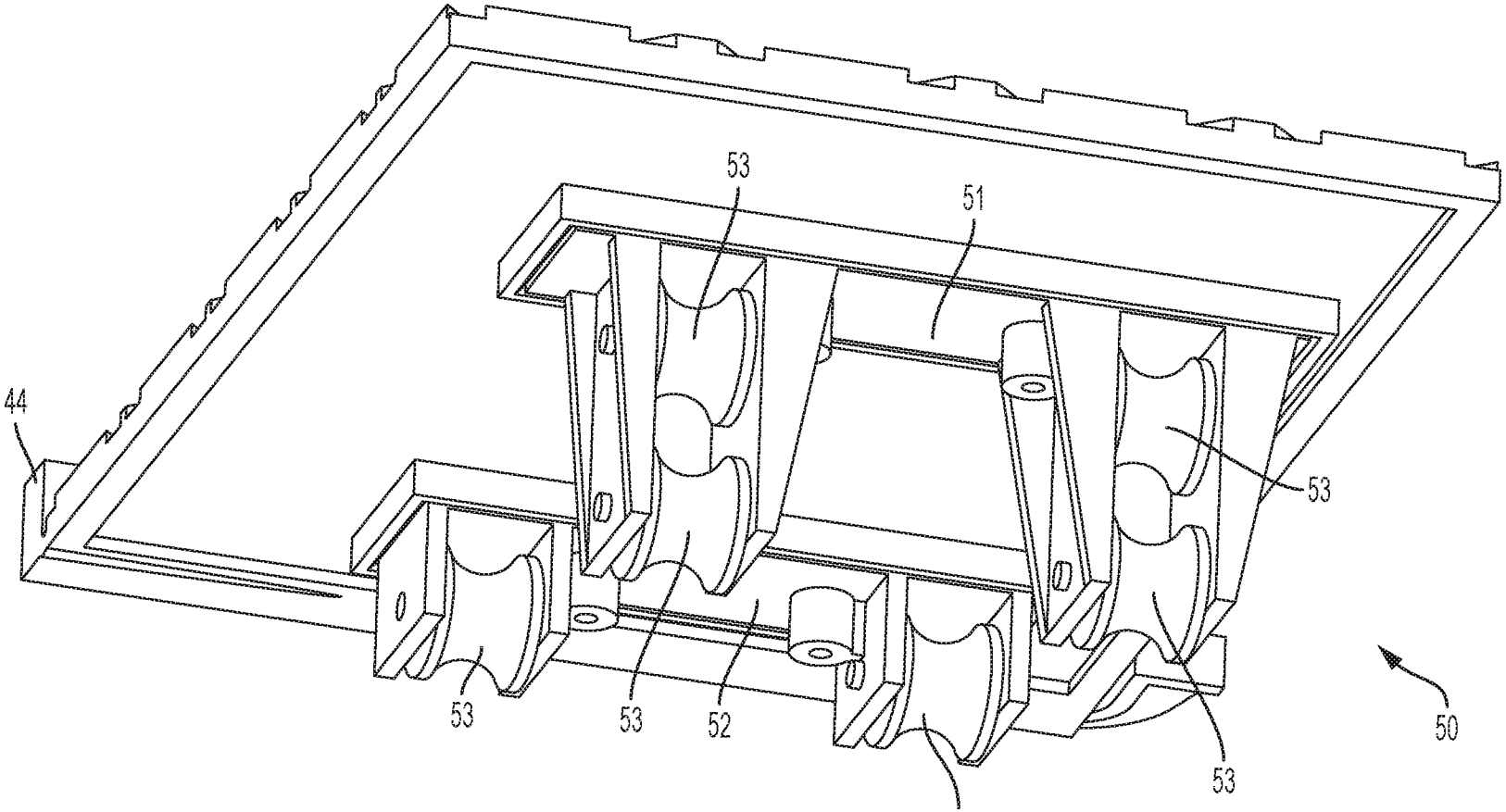
FIG. 12 is a perspective view of a tray and roller assembly according to an exemplary embodiment of the present application.

FIG. 12 shows an underside of the sliding tray 40. Attached to the underside of the sliding tray 40 is a roller assembly 50. The roller assembly 50 includes a first roller assembly 51 and a second roller assembly 52. The first roller assembly 52 includes two sets of rollers 53 each set including two rollers 53. One roller 53 from each set will be on each side of the rails 81, as shown in FIG. 9, so that the tray 40 is secured to the rails 81 and cannot be removed. The second roller assembly 52 includes only a single roller 53 for each rail 81. The rollers 53 of the second roller assembly 52 ride on top of the respective rails 81. If the tray 40 is not secured to the rails 81 in any other manner, the configuration shown in FIG. 12 will allow for back 44 of the tray 40 to rotate around the first roller assembly 51 towards the saw 60 since the second roller assembly 52 does not fixedly secure the tray 40 to the rails 81. The rotation will be limited by the opposite end of the tray 40 contacting the rails 81.

Figure 19:
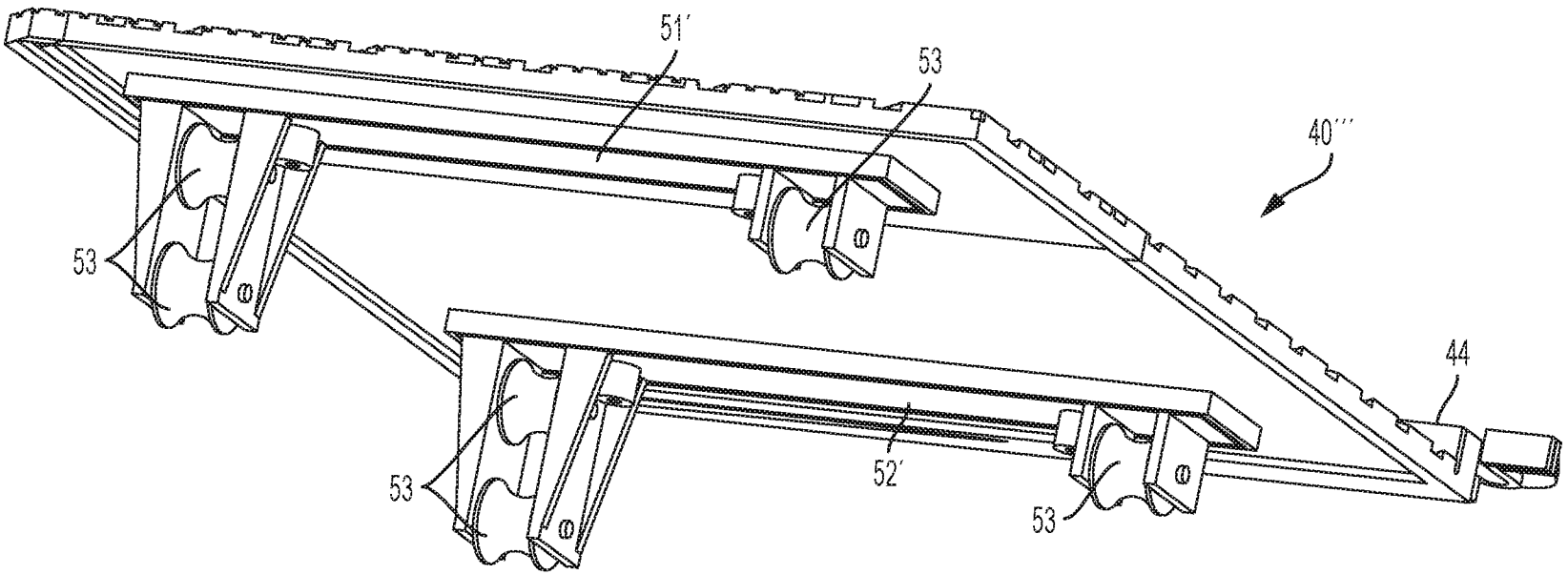
FIG. 19 is another perspective view of a tray and roller assembly according to an exemplary embodiment of the present application.
Figure 20:
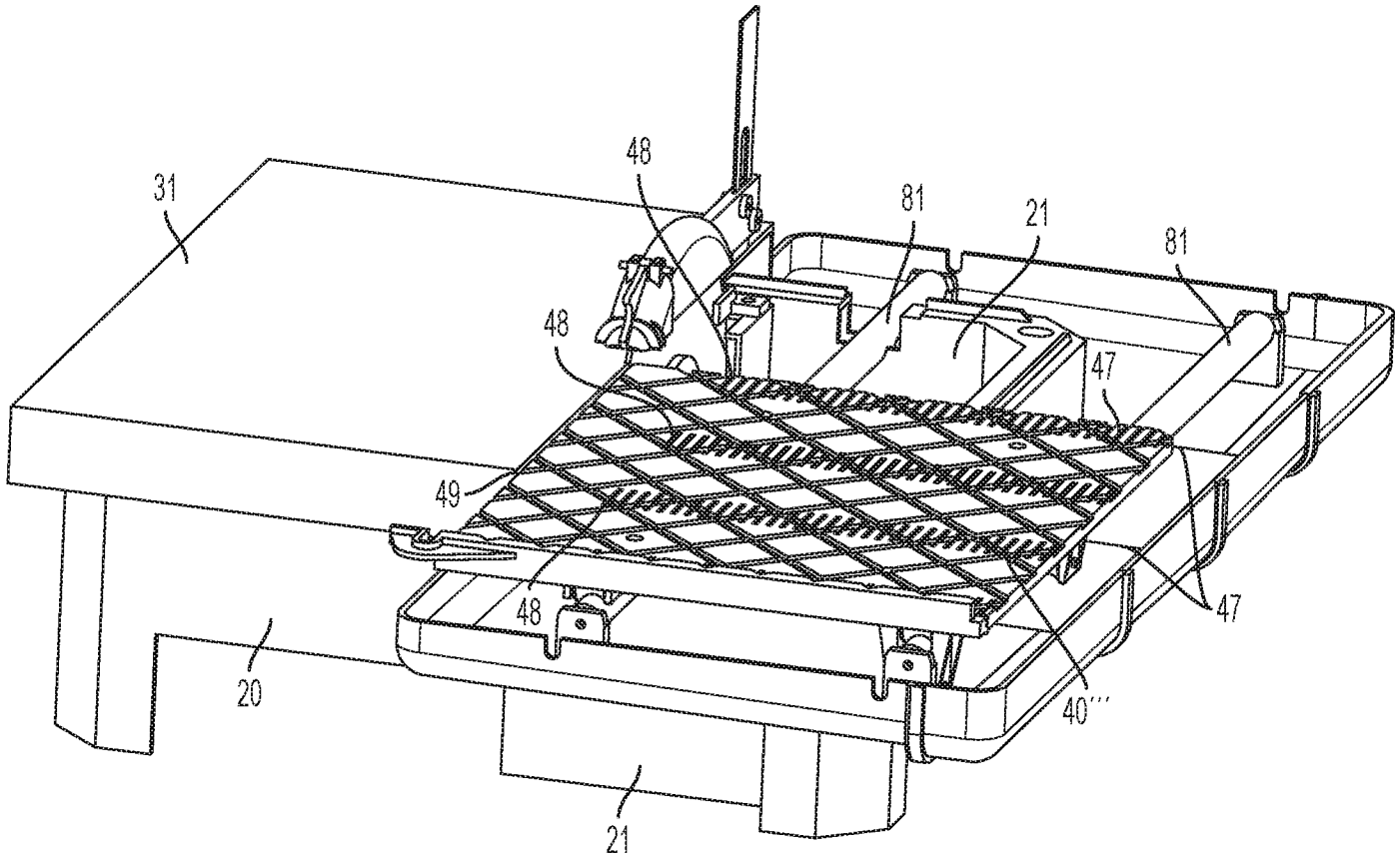
FIG. 20 is a perspective view of another exemplary embodiment of the sliding table tile saw with an outwardly pivoting tray.
Figure 21:
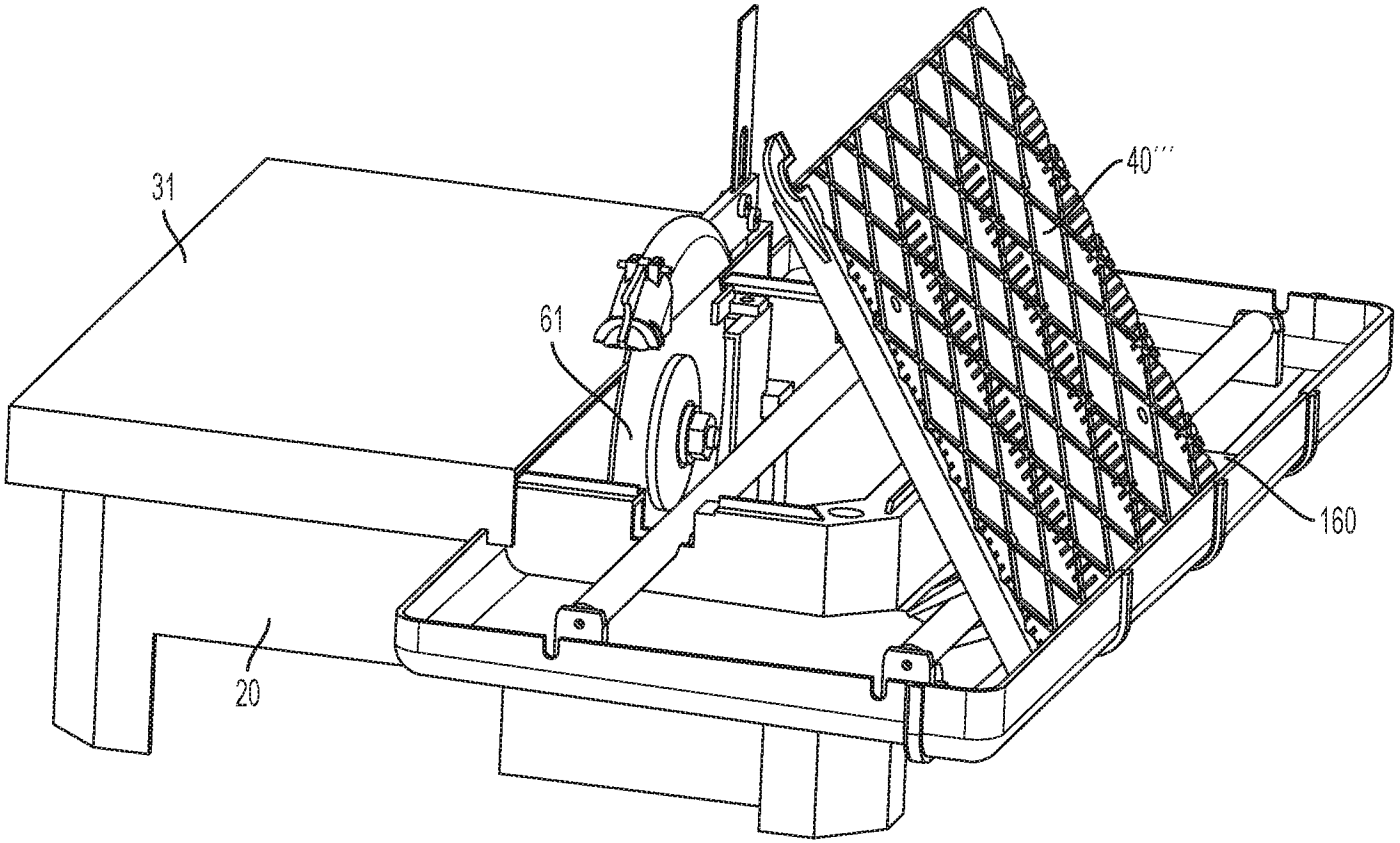
FIG. 21 is another perspective view of the exemplary embodiment of the sliding table tile saw with an outwardly pivoting tray.
Figure 22:
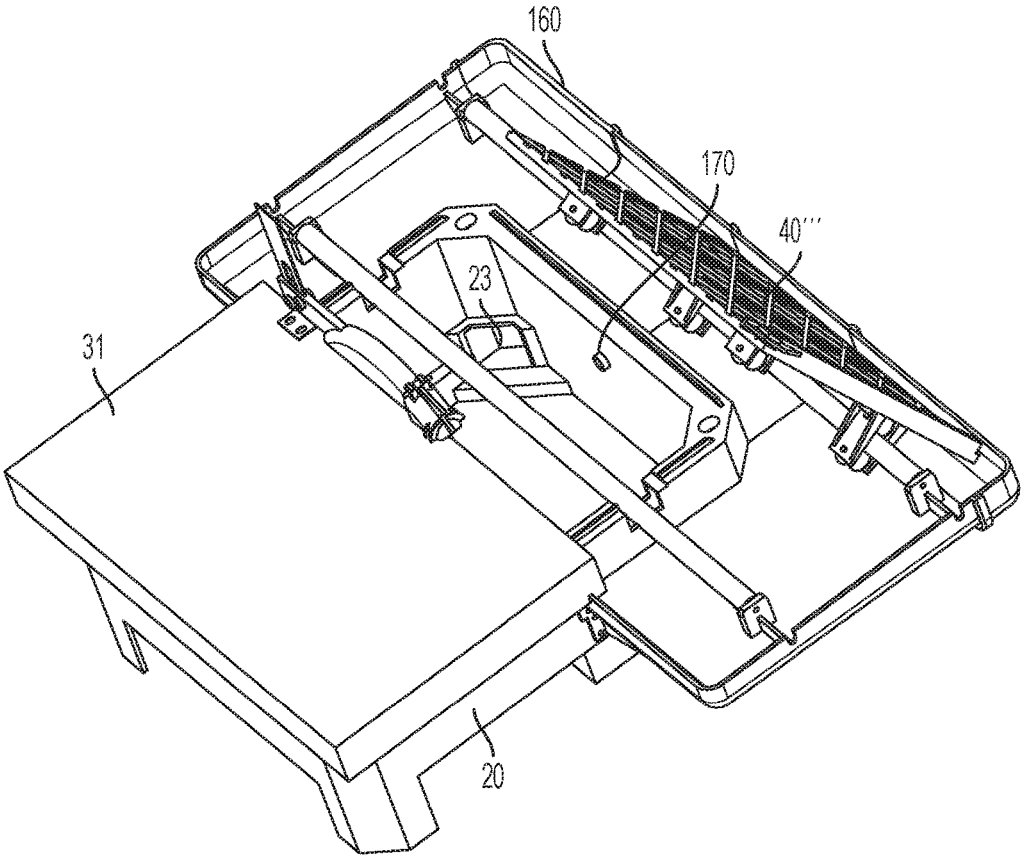
FIG. 22 is another perspective view of the exemplary embodiment of the sliding table tile saw with an outwardly pivoting tray.
Figure 23:
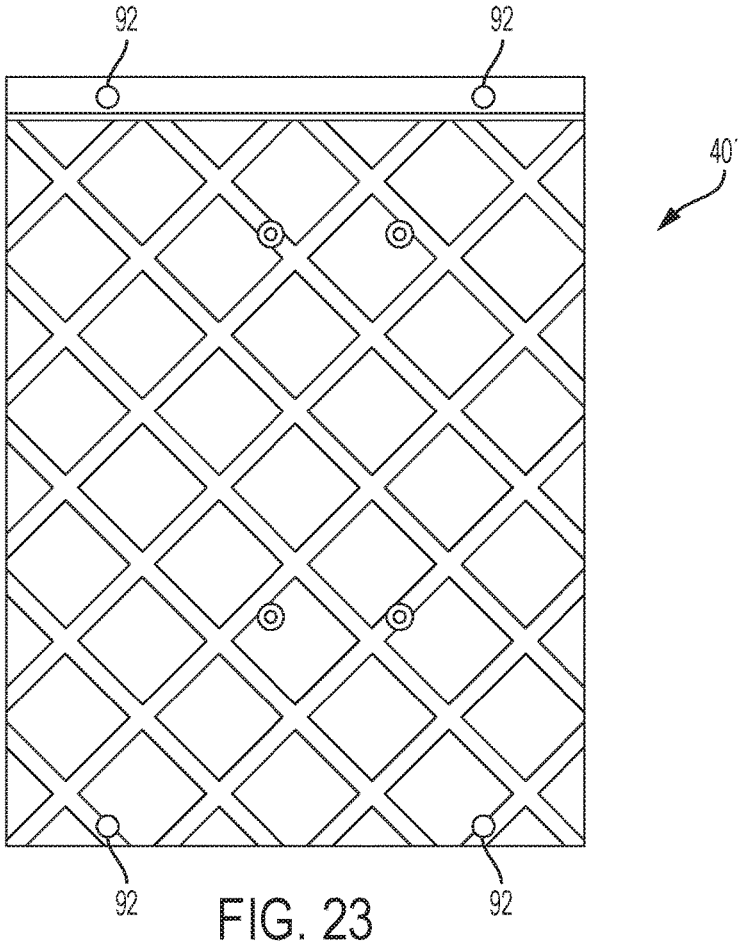
FIG. 23 illustrates a tray according to another exemplary embodiment.
Figure 24:
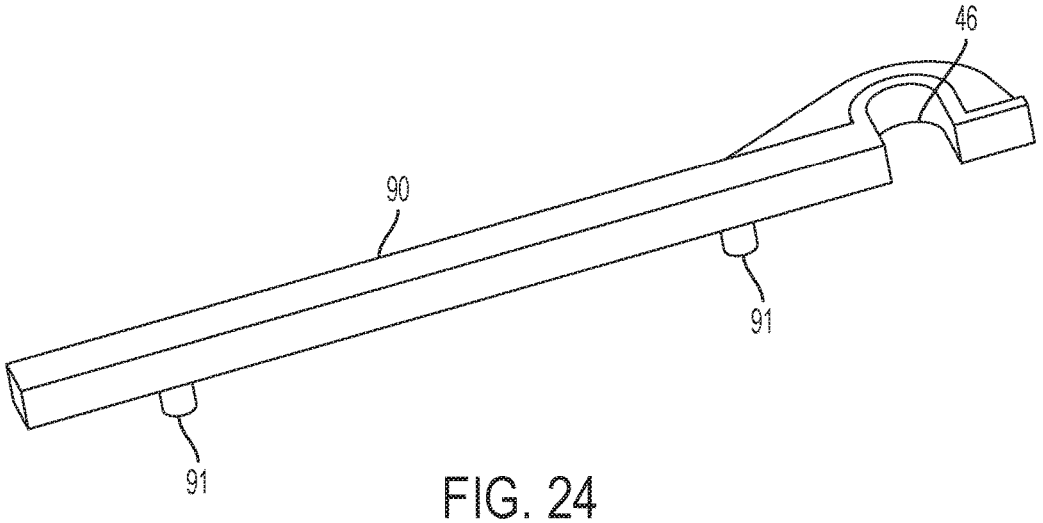
FIG. 24 illustrates an exemplary embodiment of a support for use with the tray of FIG. 23.

In another embodiment, the arrangement of the rollers 53 and the rails 81 may be different. For example, another embodiment is shown in FIGS. 19-22 with a different roller arrangement. As shown in FIG. 19, the first roller assembly 51' includes one set of two rollers 53 on a side of the tray 40''' closest to the side edge of the sliding table tile saw 10 and a single roller 53 on the opposite side. Similarly, the second roller assembly 52' also includes one set of two rollers 53 on a side of the tray 40''' closest to the side edge of the sliding table tile saw 10 and a single roller 53 on the opposite side. Accordingly, in this embodiment, the tray 40''' will be secured to one rail 81 with a pair of rollers 53 from the first assembly 51' and a pair of rollers from the second assembly 52. That is, the tray 40''' will be secured to one rail 81 by four rollers 53, with two rollers 53 above the rail 81 and two rollers 53 below. On the other hand, the tray 40''' engages another rail 81 with only two rollers 53, each on top. Accordingly, the tray can be set flat, as shown in FIG. 20 and can also be pivoted about one of the rails, as shown in FIGS. 21 and 22. As shown in FIGS. 21 and 22, rotating the tray 40 provides easy access to the basin 21 below and may be useful for cleaning the tray 40 or basin 21.

As can be seen in FIGS. 20-22, the tray 40''' has an expanded width in comparison to the tray 40. Additionally, one of the rails is disposed in a skirt 160 (to be discussed below) rather than both rails being disposed above the basin 21. Furthermore, the tray includes three rows a straight line markings 47. The markings 47 in each row are set apart from one another by a uniform amount. For example, the markings 47 in each row may be set ⅛" or ¼" apart from one another. Additionally, a distance from an edge 49 of the tray 40''' to a first marking 48 in each row may be known. In this manner, the user may use the markings 47 to determine the dimension of a tile 200 being cut.

Figure 13:
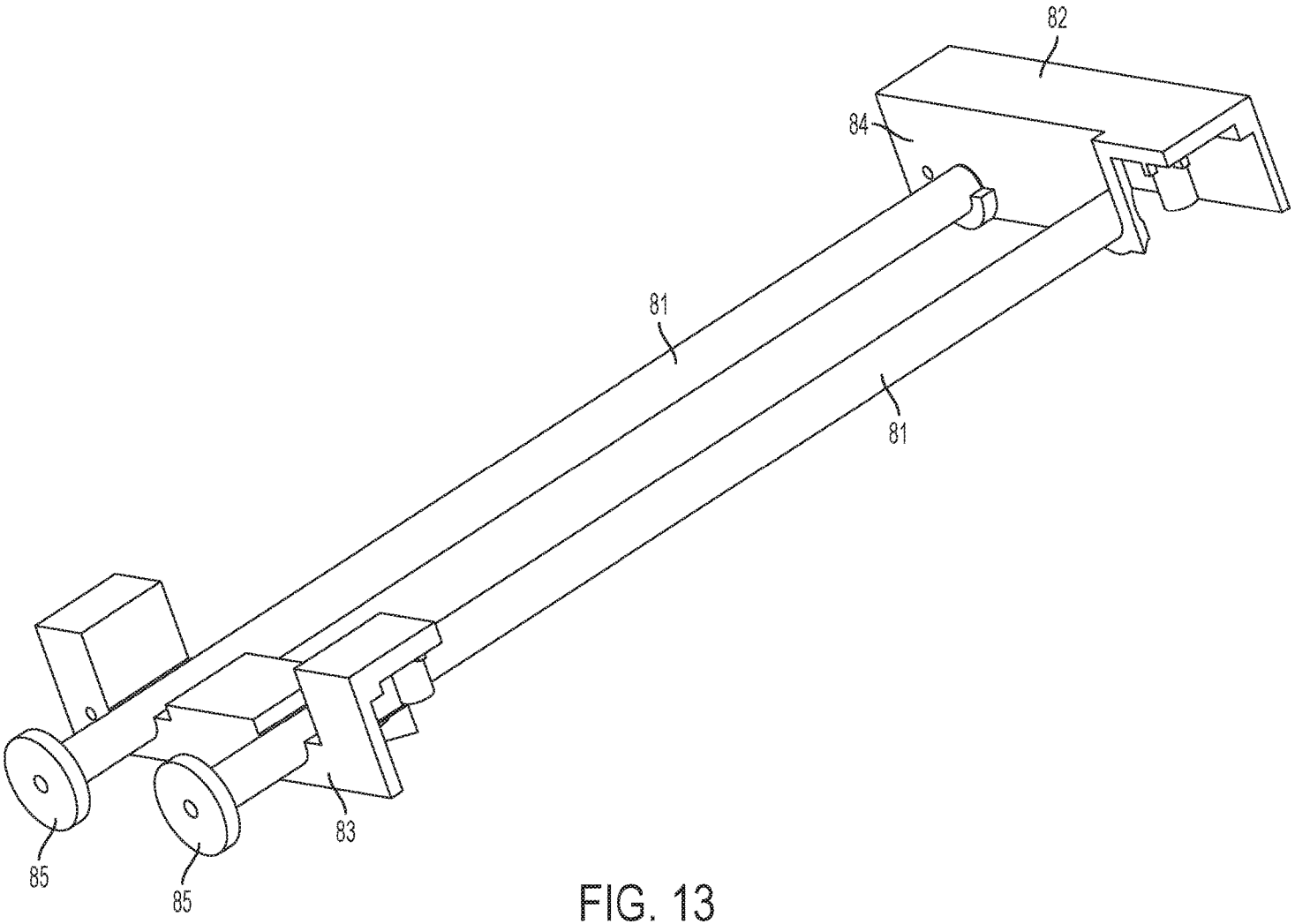
FIG. 13 is a perspective view of a rail assembly according to an exemplary embodiment of the present application.

FIG. 13 illustrates the rail assembly 80. The rail assembly 80 includes a pair of rails 81 on which the sliding tray 40 slides via the previously discussed rollers 53. The rails 81 are supported on the sliding table tile saw 10 by a first end support 82 and a second end support 83. The first end support 82 is a stopping point for a front end of the tray 40. It also includes a recessed portion 84 which accommodates larger tiles. As shown in FIG. 13, the rails 81 extend through the second end support 83. End stops 85 are provided at the end of the rails 81 for limiting movement of the tray 40 and preventing the tray 40 from falling off of the rails 81.

Figure 14:
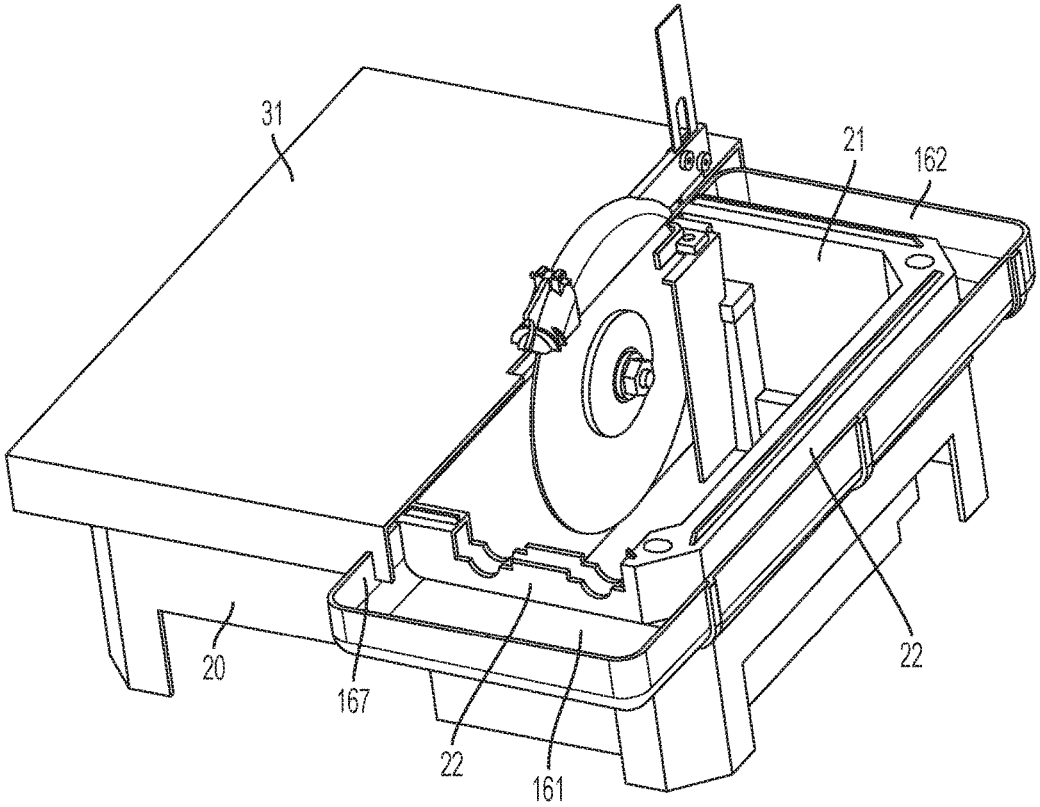
FIG. 14 is a perspective view of the exemplary embodiment of the sliding table tile saw with various parts removed.
Figure 15:
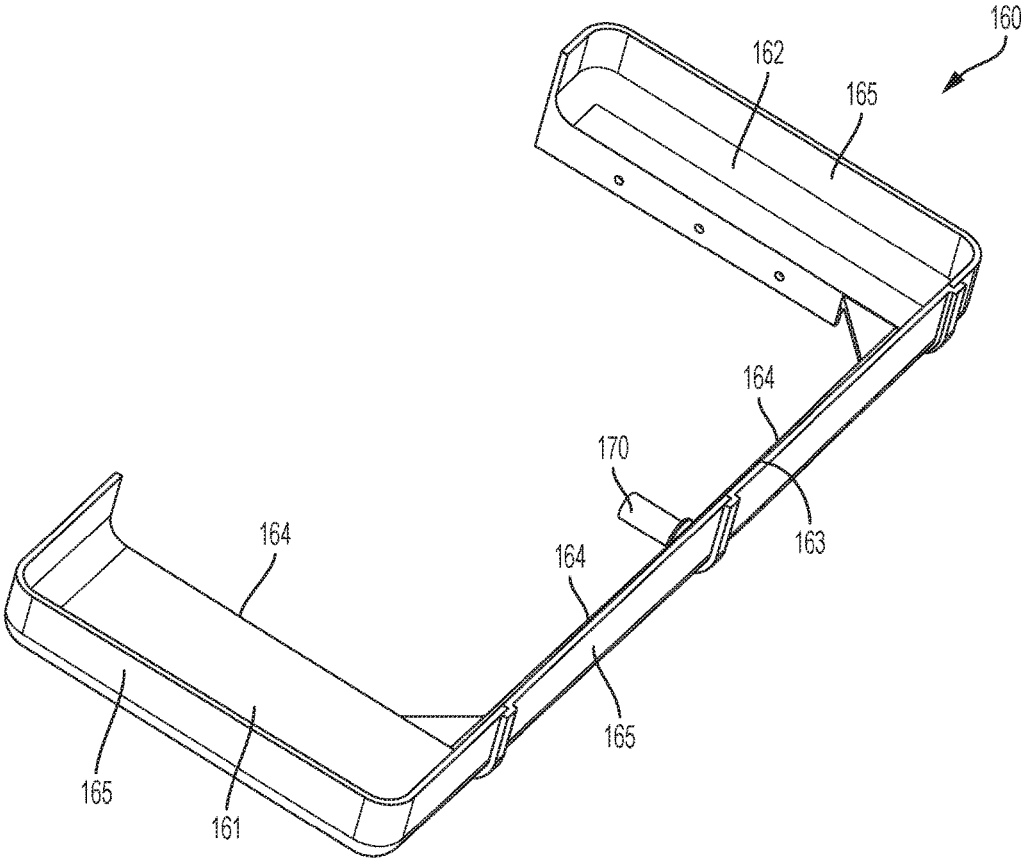
FIG. 15 is a perspective view of the exemplary embodiment of a skirt of the sliding table tile saw.

FIGS. 14 and 15 illustrate a skirt 160. The skirt 160 is attached as part of the sliding table tile saw 10 around the basin 21. The skirt 160 serves to direct water that has left the basin 21 back into the basin 21. As shown in FIGS. 14 and 15, the skirt 160 extends along three sides of the sliding table tile saw 10. Particularly, it has a first end 161, a second end 162 and a side 163. The inside surface 164 of the skirt 160 abuts against an outer surface 22 of the basin 21 in a watertight manner. Accordingly, water is held between the outer wall 165 of the skirt 160 and the outer wall 22 of the basin 21. As shown in FIG. 14, the skirt 160 can extend beyond the basin 21 and movable tray 40 portions of the sliding table tile saw 10 and overlap with the fixed table surface 31. In the exemplary embodiment, an end 167 of the skirt 160 engages a surface of tray 31.

The skirt 160 further includes a connection tube 170. The connection tube 170 is a hollow tube and passes through the wall of the basin 21 so that water from the skirt 160 is drained back into the basin 21 through the tube 170. The end of the tube 170 that drains into the basin can be seen in FIG. 22. In use, water that is sprayed out of the basin 21 is caught by the skirt 160, the water is caught by the skirt 160 and drained back into the basin 21 through the tube 170. In this manner, the exemplary embodiment provides for less loss of water so that less mess is created and the basin 21 needs to be refilled less often.

As seen in FIG. 22, the basin 21 itself has a basin drain 23. The basin drain 23 limits the amount of water that can be put into the basin 21. Additionally, it allows a user to pour out water from the basin 21 such as after a user is done with the sliding table tile saw 10 and wants to store it away.

Figure 16:
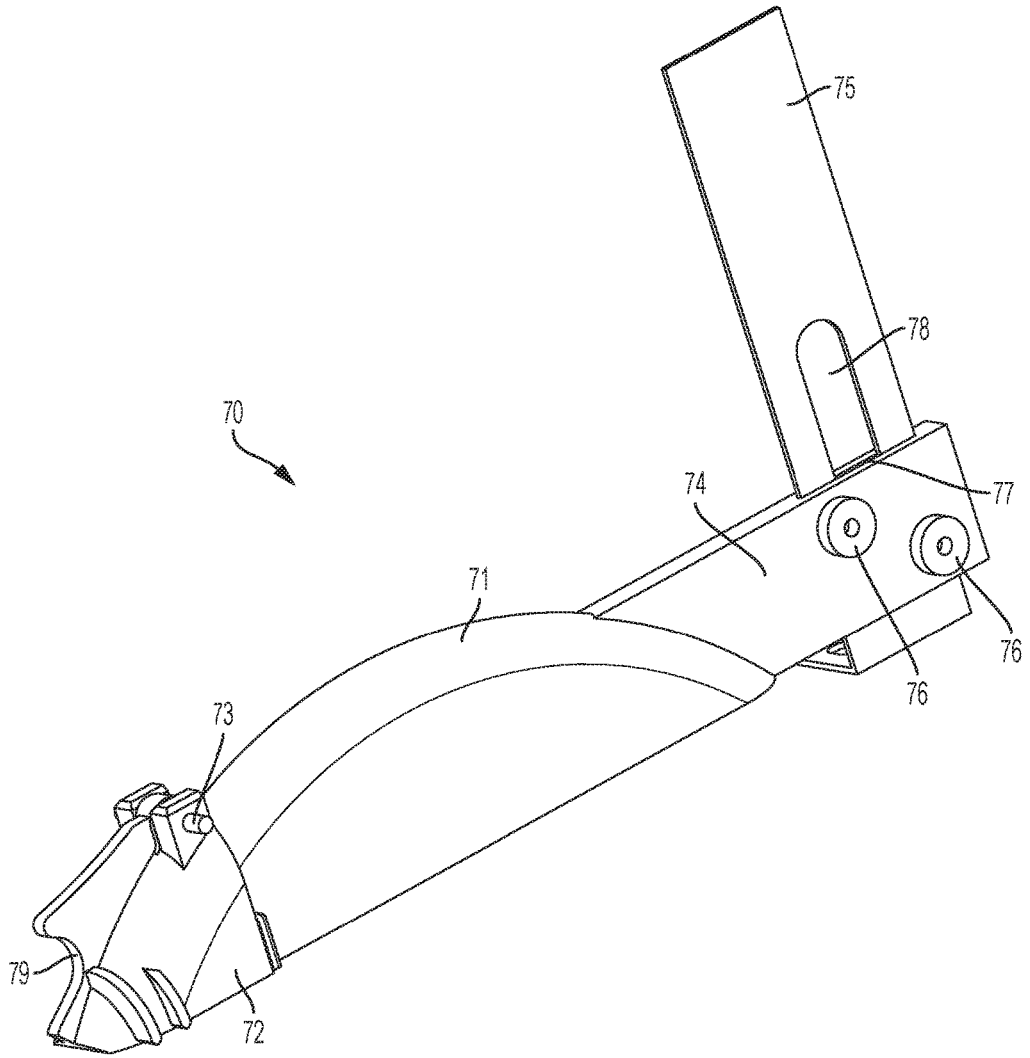
FIG. 16 is a perspective view of an exemplary embodiment of the blade guard.
Figure 17A:
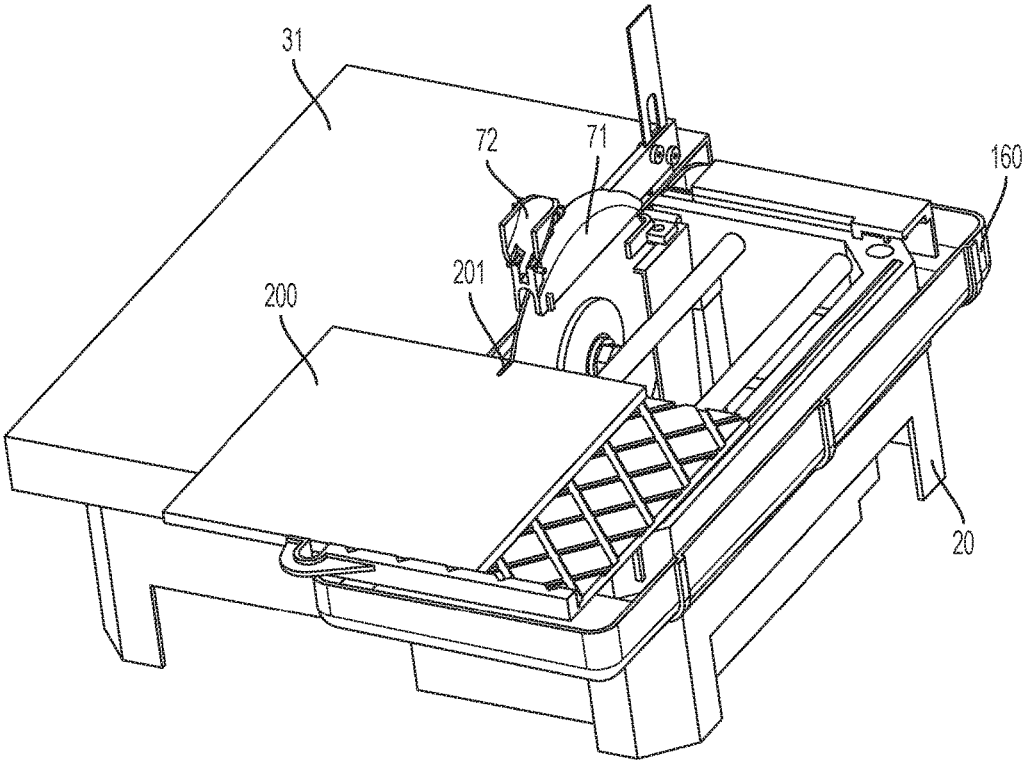
FIG. 17A is a another perspective view of the exemplary embodiment of the sliding table tile saw with a marked tile.
Figure 17B:
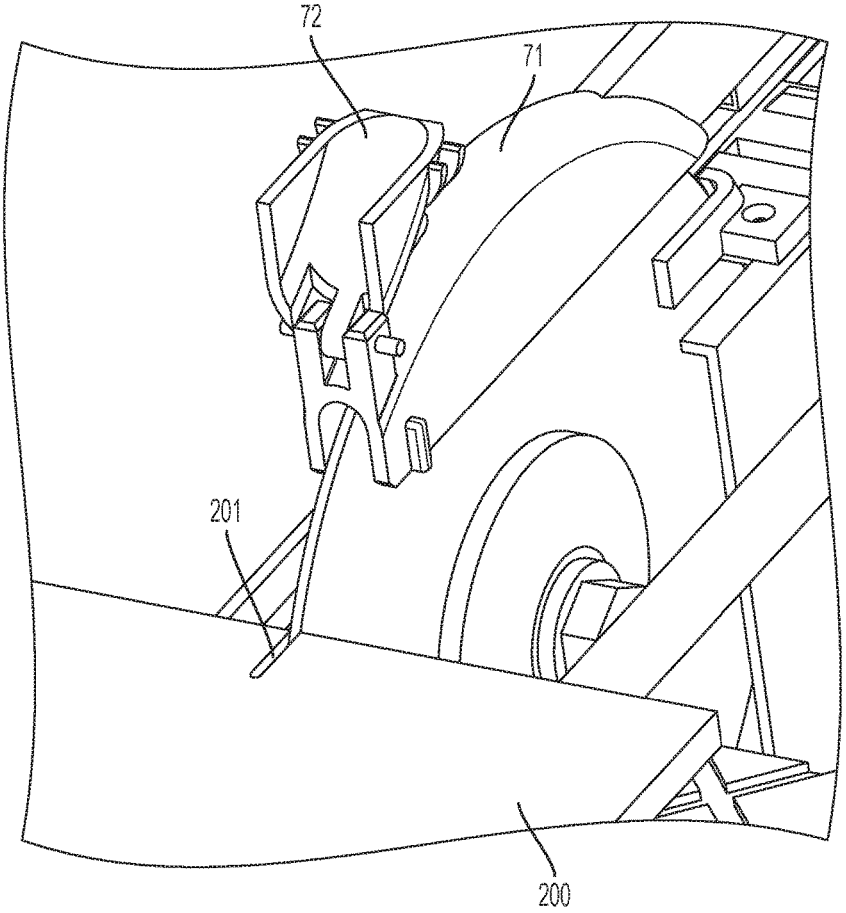
FIG. 17B is a another perspective view of the exemplary embodiment of the sliding table tile saw with a focus on the marked tile at a cutting point.

FIGS. 16-17B illustrate the saw blade 61 and blade guard 70 in more detail. The blade guard 70 is disposed over a cutting edge of the saw blade 61. The blade guard 70 includes a fixed portion 71 and a movable portion 72 which can move with respect to the fixed portion 71. In this case, the movable portion 72 rotates with respect to the fixed portion 71. The movable portion 72 is connected to the fixed portion 71 via a connector 73. In the exemplary embodiment, the connector 73 is a pin. Other connectors may also be used. The movable portion 72 also includes a recess 79. The recess 79 is configured for a user to engage and move the movable portion 72 to the open position shown in FIGS. 17A and 17B.

The blade guard 70 is attached to the tool through a mounting bracket 74 and a mounting support 75. The mounting support 75 is fixed, for example, to the fixed table surface 31, for example by fasteners. The mounting support 75 could be fixed to other surfaces or in other manners or could be integrally formed with other parts of the sliding table tile saw 10. The mounting bracket 74 has an opening 77 which receives a portion of the mounting support 75. The mounting bracket 74 further has a pair of fasteners 76 which can be tightened or loosened to secure the mounting bracket 74 at a particular height with respect to the mounting support 75. The mounting support has an opening 78 to accommodate the fasteners 76. As will be appreciated, a user can loosen the fasteners 76 via the hex sockets on the fasteners 76 and can then move the mounting bracket 74 up or down to a desired location. The user can then retighten the fasteners 76 to secure the mounting bracket 74 in place. For example, the user may want to raise the mounting bracket 74 to allow for replacement of the saw blade 61 and have it at a lower position for use of the blade guard 70.

FIGS. 17A and 17B illustrate the movable portion 72 of the blade guard 70 in an open position. Moving the movable portion 72 to the open position allows a user to see where the saw blade 61 will cut the tile 200. As shown in FIGS. 17A and 17B, a user may make a mark 250 on the tile 200 to aid with lining up the cut.

Figure 18:
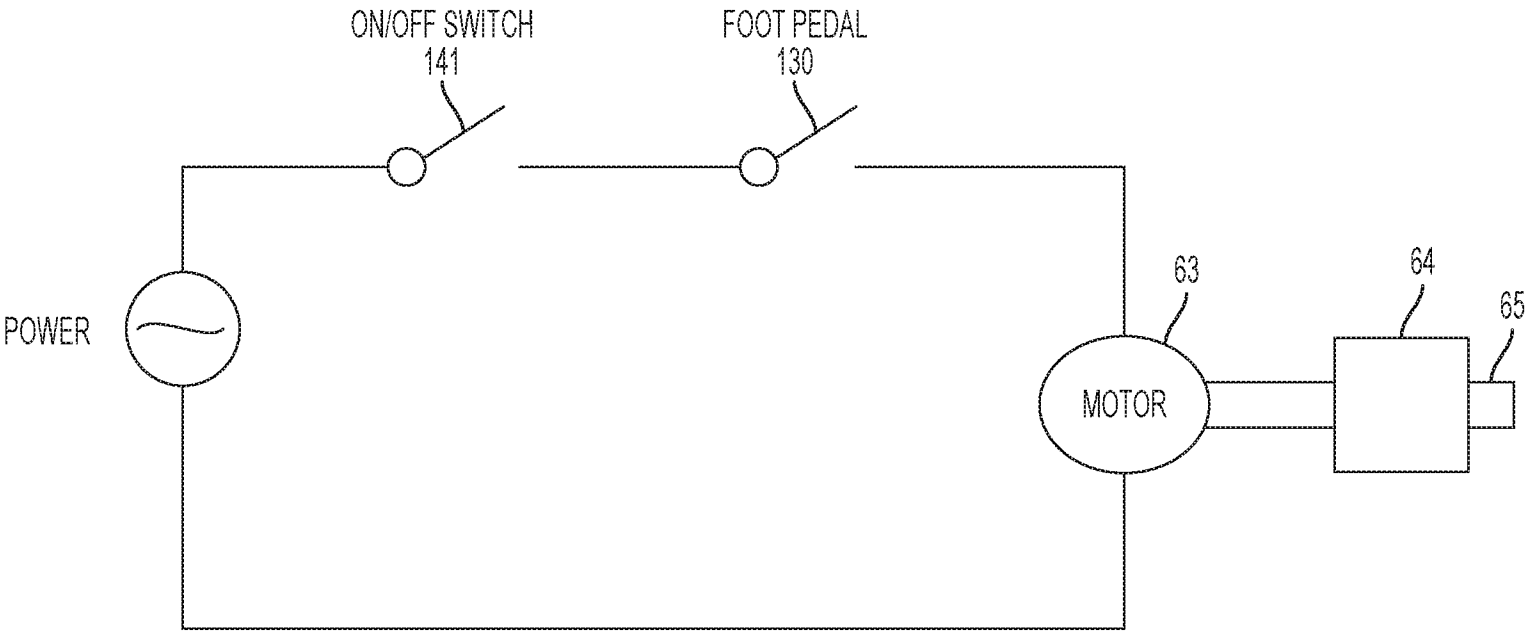
FIG. 18 is a simple schematic of operation of the saw of the sliding table tile saw.

FIG. 18 is a simplified schematic for the operation of the saw 60. As shown in FIG. 18, power is provided, for example via a power cord 140. An on/off switch 141 and the foot pedal 130 are electrically interposed between the power source and a motor 63 of the saw 60. The on/off switch 141 has to be turned on and the foot pedal 130 has to be depressed in order for the motor 63 to be turned on. Other embodiments may include only one of the on/off switch 141 and the foot pedal 130. As shown in the schematic, the motor 63 drives an output 65 through a transmission 64. The saw blade 61 is coupled to the rotating output 65. As previously discussed, the motor 63 and transmission 64 are housed in the motor and transmission housing 62.

Another exemplary embodiment is shown in FIGS. 23-30. The embodiment of FIGS. 23-30 is the same as the previous embodiments unless otherwise specified. In the embodiment of FIGS. 23-30, the sliding table 40' include the tray back 44 that is shown in, for example, FIG. 11. Instead, the sliding tray 40' includes a removable support 90 that can be connected to the tray 40'. The removable support 90 includes a pair of mounting pins 91. The mounting pins 91 can fit into corresponding mounting holes 92 in the tray 40'. Thus, the removable support 90 can be mounted on different positions on the tray 40' or even removed from the tray 40' entirely.

Figure 25:
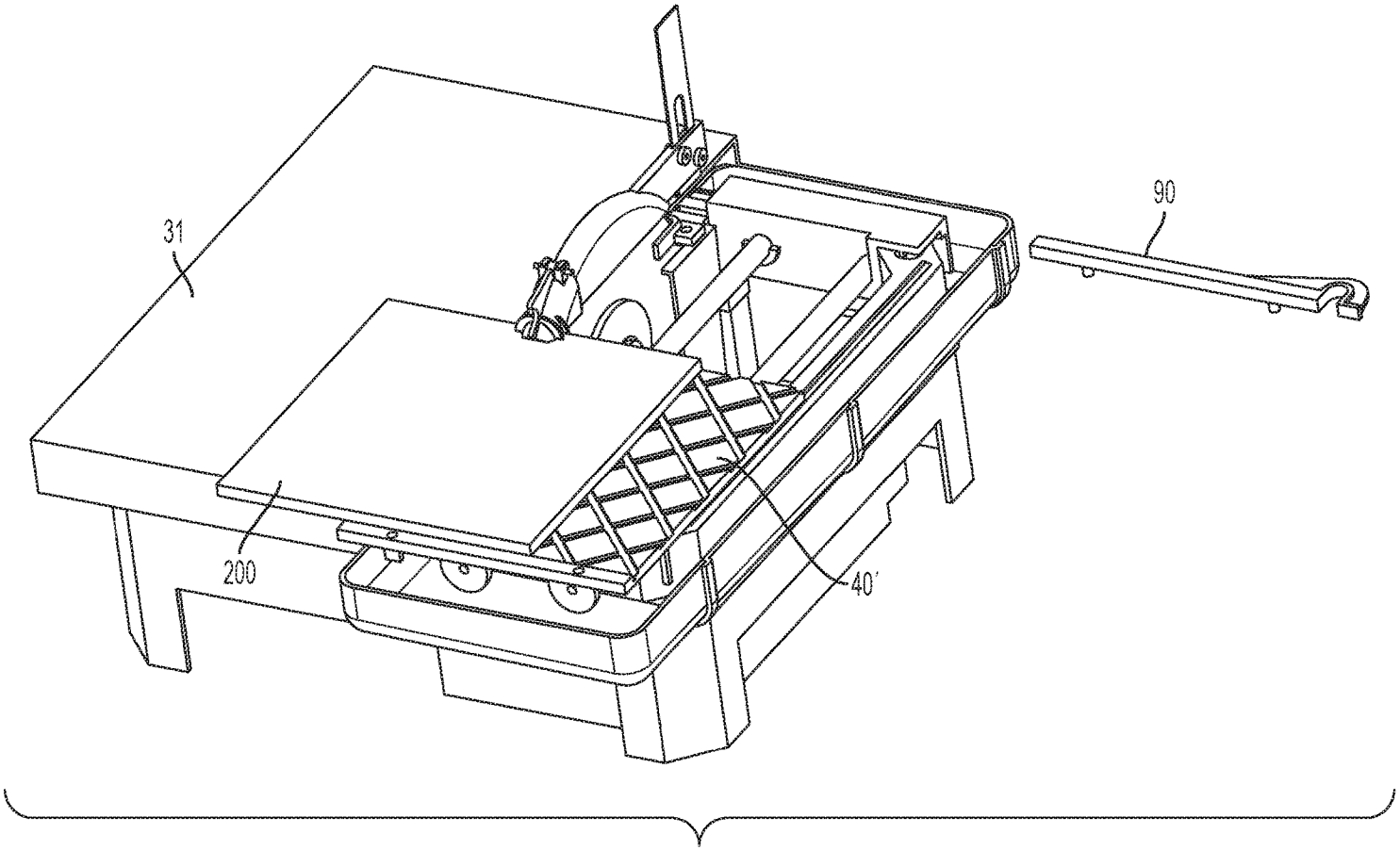
FIG. 25 is a perspective view of an exemplary embodiment of the sliding table tile saw with the tray of FIG. 23 and support of FIG. 24.

FIG. 25 shows the saw with the removable support 90 removed. The sliding table tile saw 10 may be used in this configuration if a user does not want a support. As shown in FIG. 25, in this instance, the tile 200 can hang off an end of the tray 40 that is away from the saw 60, thus accommodating larger tiles.

Figure 26:
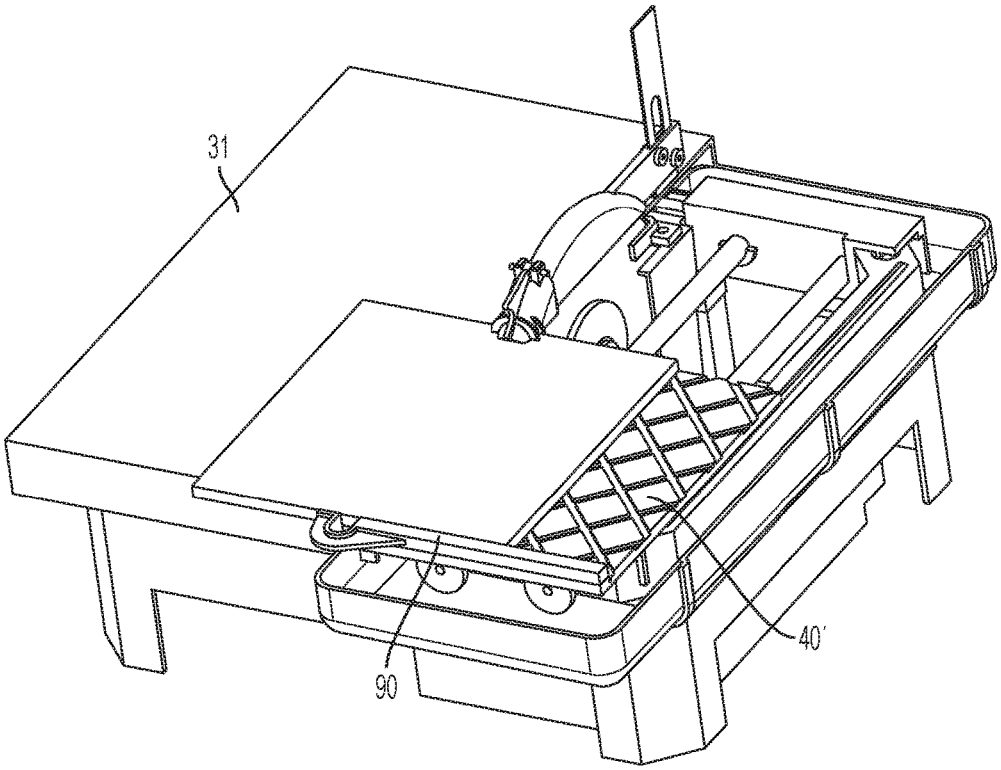
FIG. 26 is another perspective view of an exemplary embodiment of the sliding table tile saw with the tray of FIG. 23 and support of FIG. 24.
Figure 27:
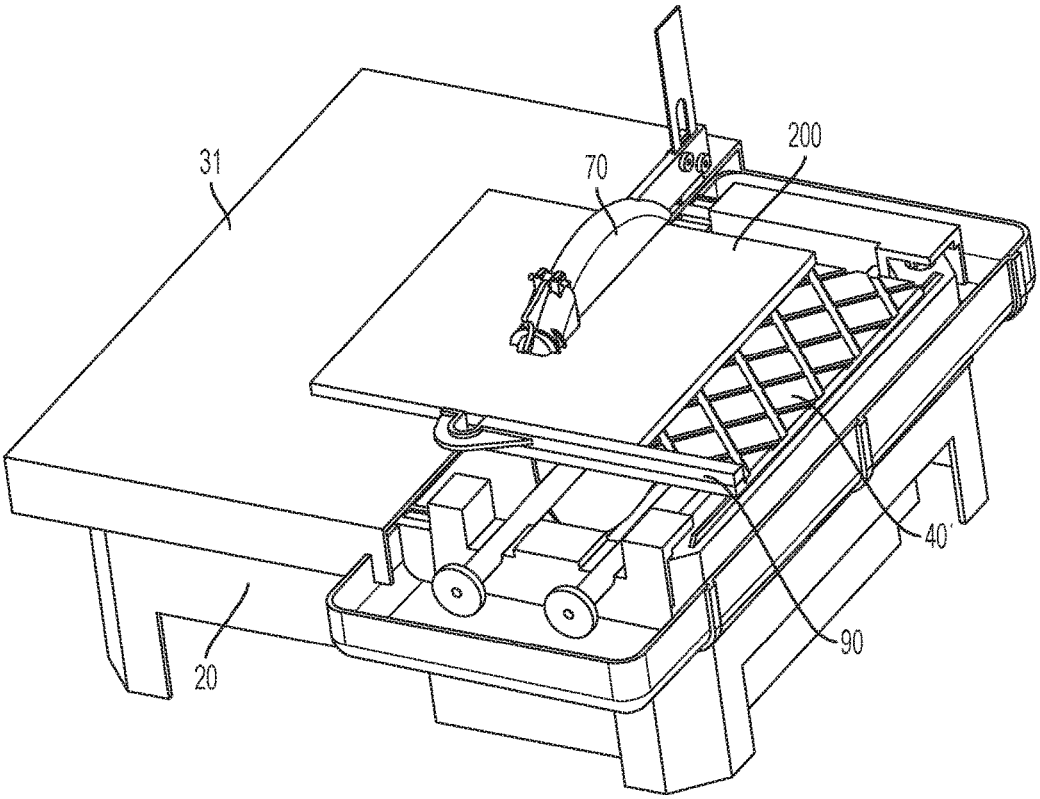
FIG. 27 is another perspective view of an exemplary embodiment of the sliding table tile saw with the tray of FIG. 23 and support of FIG. 24.
Figure 28:
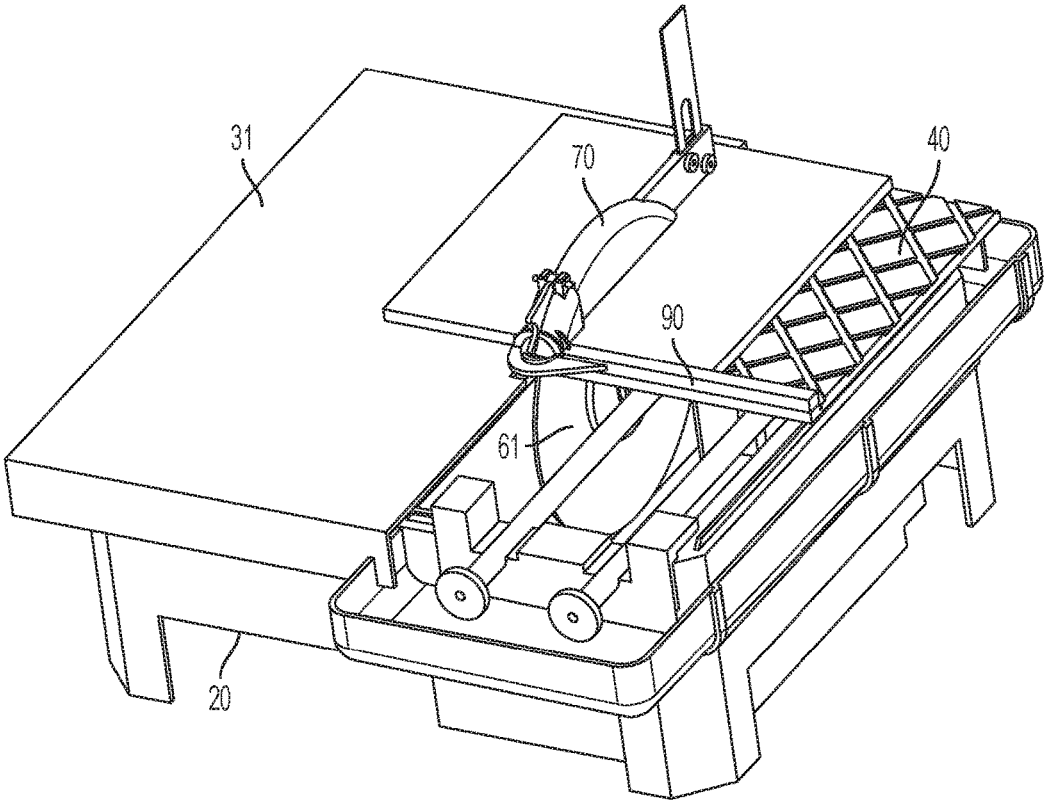
FIG. 28 is a another perspective view of an exemplary embodiment of the sliding table tile saw with the tray of FIG. 23 and support of FIG. 24.

FIGS. 26-28 illustrate cutting of a tile 200 with the support attached to the tray 40' at an end away from the saw 60. As will be appreciated, this configuration creates a cutting operation that is substantially the same as that of the fixed tray back shown in FIGS. 2-4.

Figure 29:
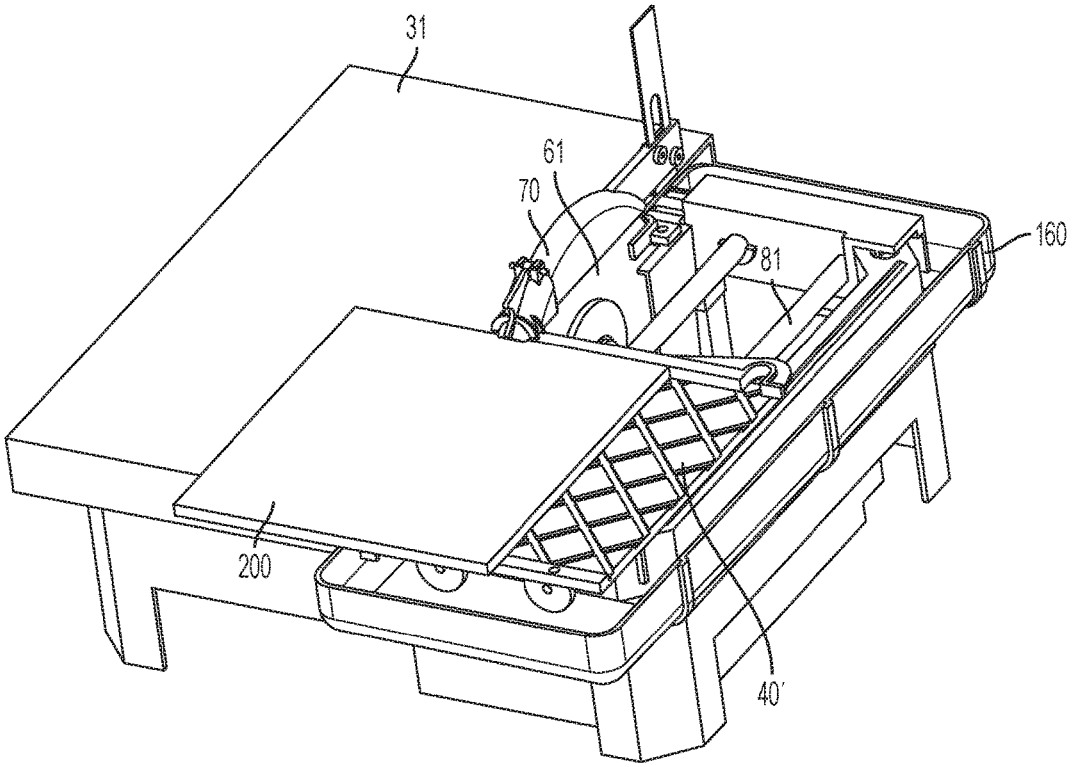
FIG. 29 is a another perspective view of an exemplary embodiment of the sliding table tile saw with the tray of FIG. 23 and support of FIG. 24.
Figure 30:
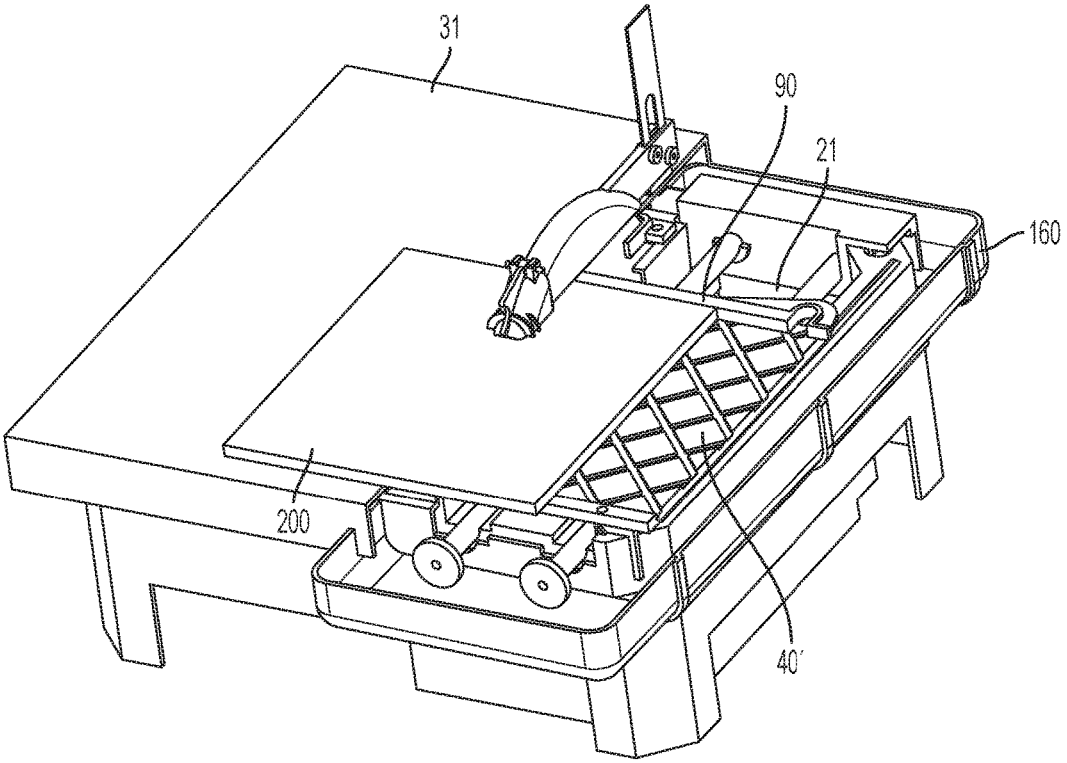
FIG. 30 is a another perspective view of an exemplary embodiment of the sliding table tile saw with the tray of FIG. 23 and support of FIG. 24.

FIGS. 29 and 30 illustrate when the support 90 is inserted into the tray 40' at an end near the saw 60. In this configuration, a user can push the tile against the support 90. Additionally, a larger tile can be accommodated because it can extend off of the side of the tray 40' opposite the support 90.

Figure 31:
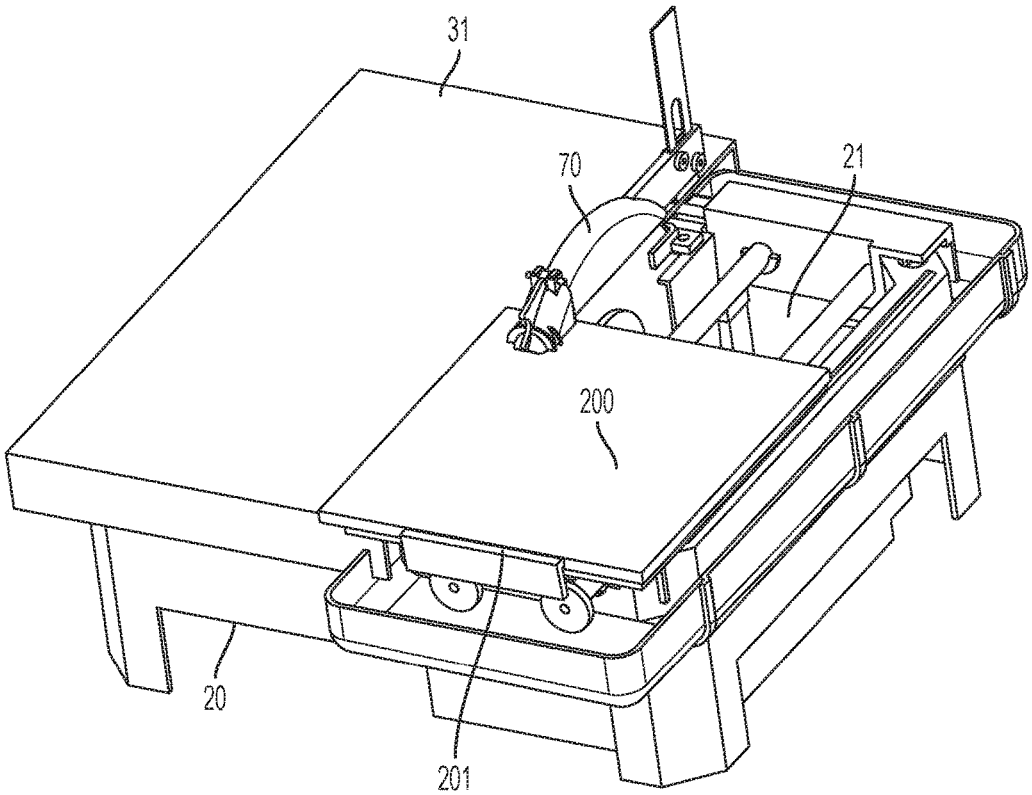
FIG. 31 is a perspective view of an exemplary embodiment of the sliding table tile saw with a movable support.
Figure 32:
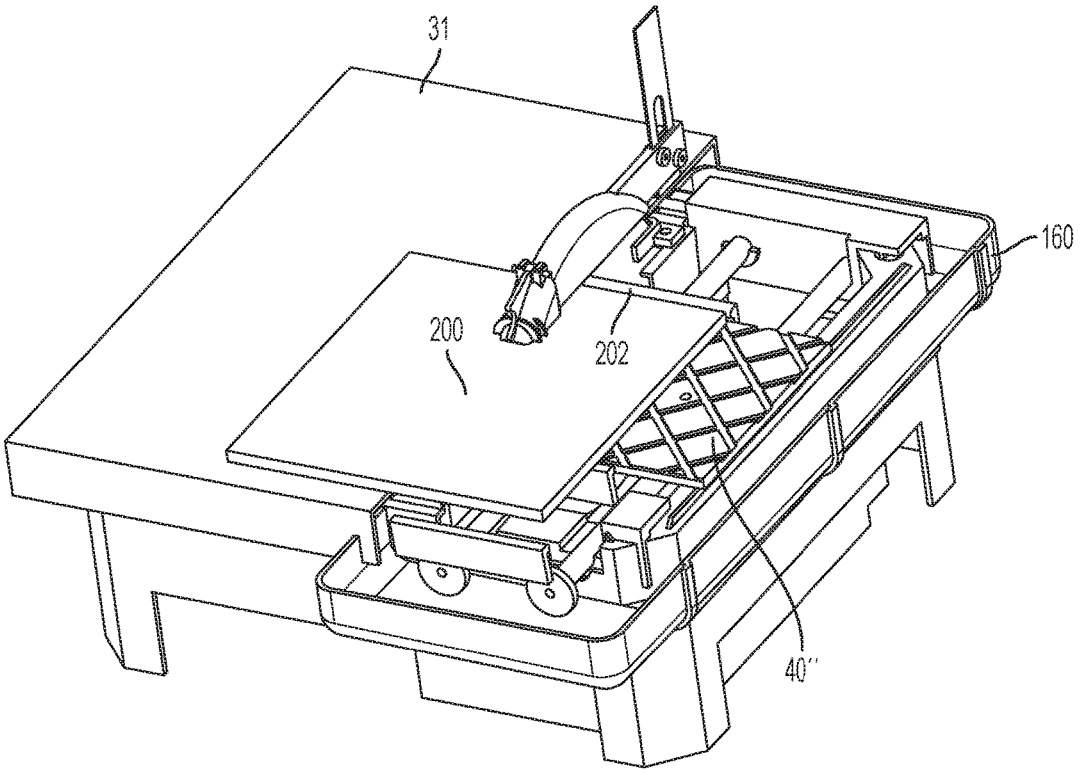
FIG. 32 is another perspective view of an exemplary embodiment of the sliding table tile saw with a movable support.
Figure 33:
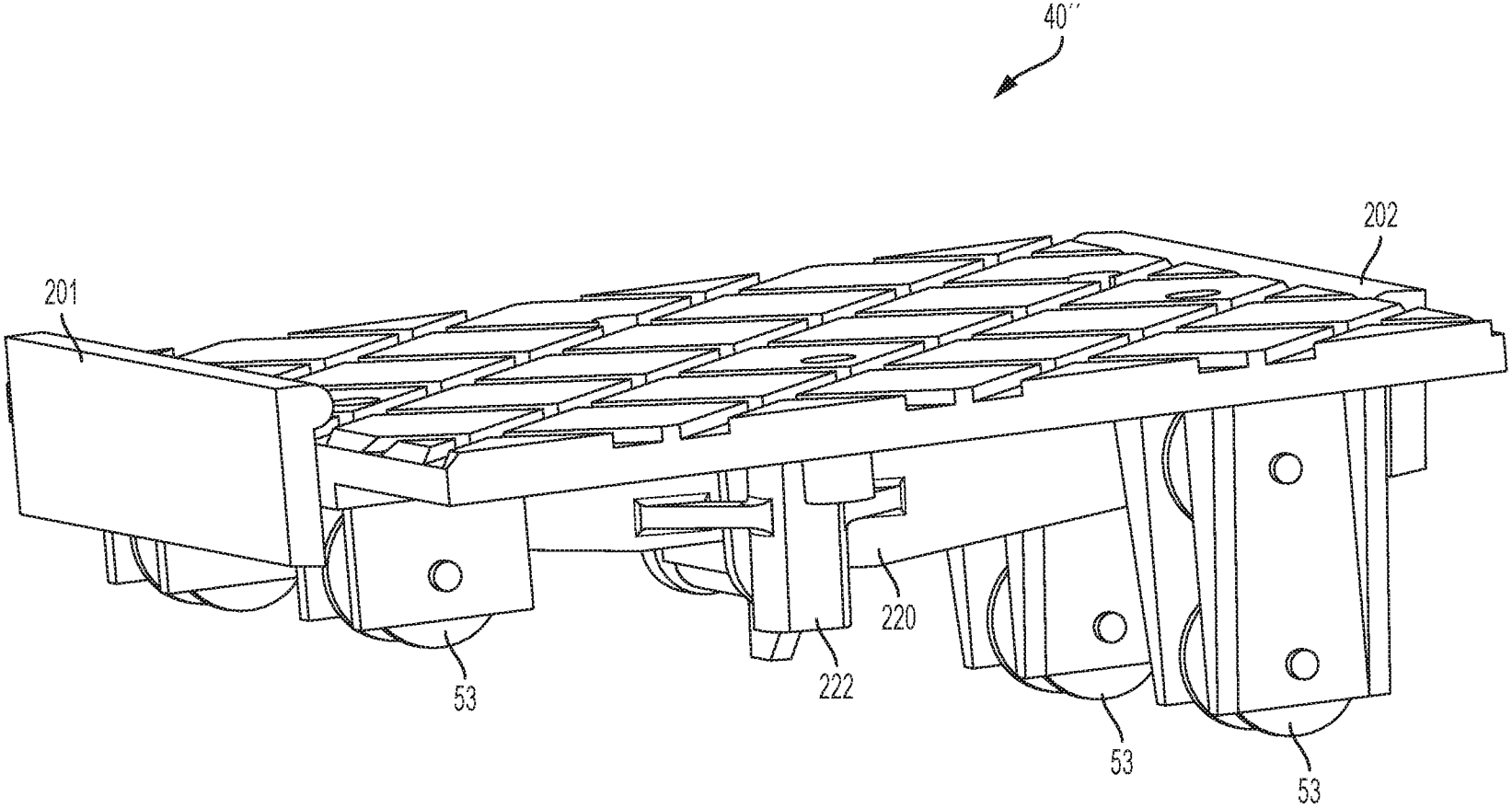
FIG. 33 is a perspective view of an exemplary embodiment of the tray with the movable support.
Figure 34:
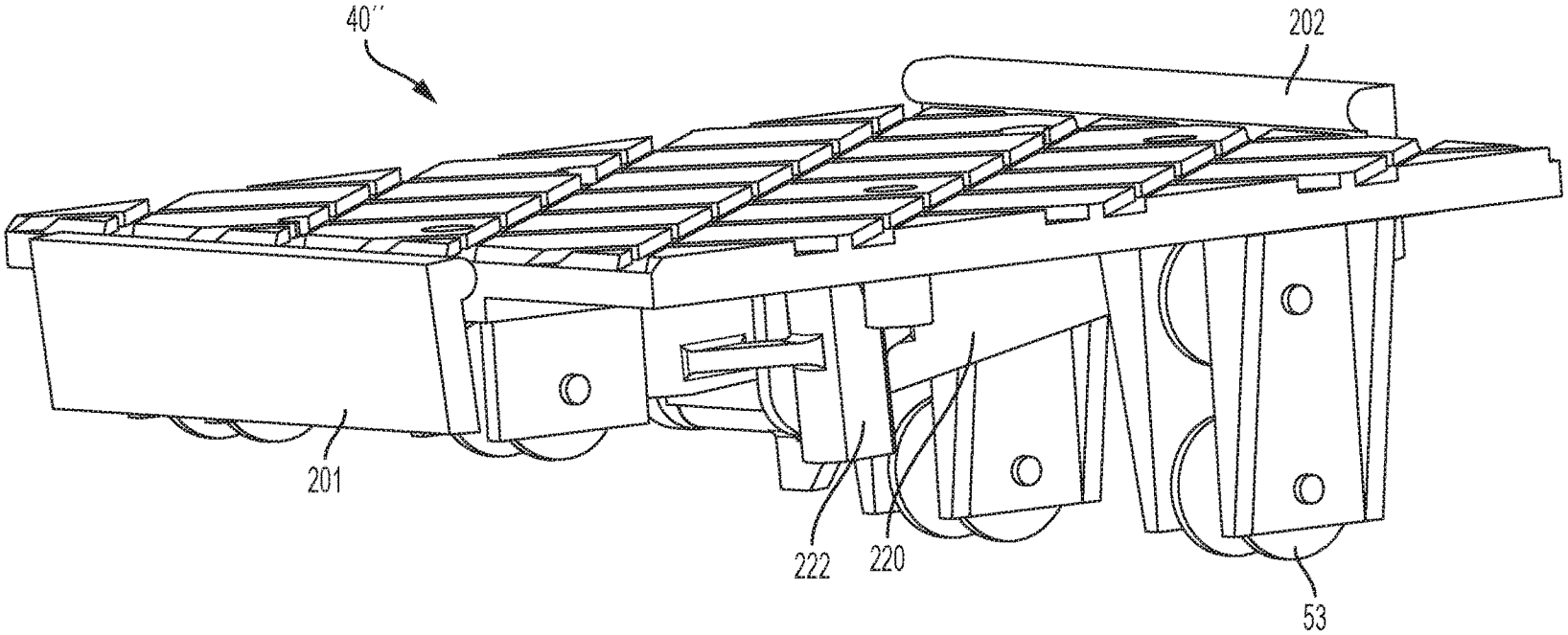
FIG. 34 is another perspective view of an exemplary embodiment of the tray with the movable support.

Another exemplary embodiment of a support system is shown and described with respect to FIGS. 31-41. As shown in FIG. 31, the support system may be positioned to provide a front tile support 201 or it may be positioned to provide a rear tile support 202 as shown in FIG. 32. FIGS. 33 and 34 show this operation in more detail. As shown in FIG. 33, the front tile support 201 may be positioned to extend above a surface of the tray 40". As shown in FIG. 34, the user may switch the support so that the front tile support 201 is level with or below a top of the tray 40" so as not to impede a tile 200 and the rear tile support 202 is above the top surface of the tray so as to provide a support for the tile.

Figure 37:
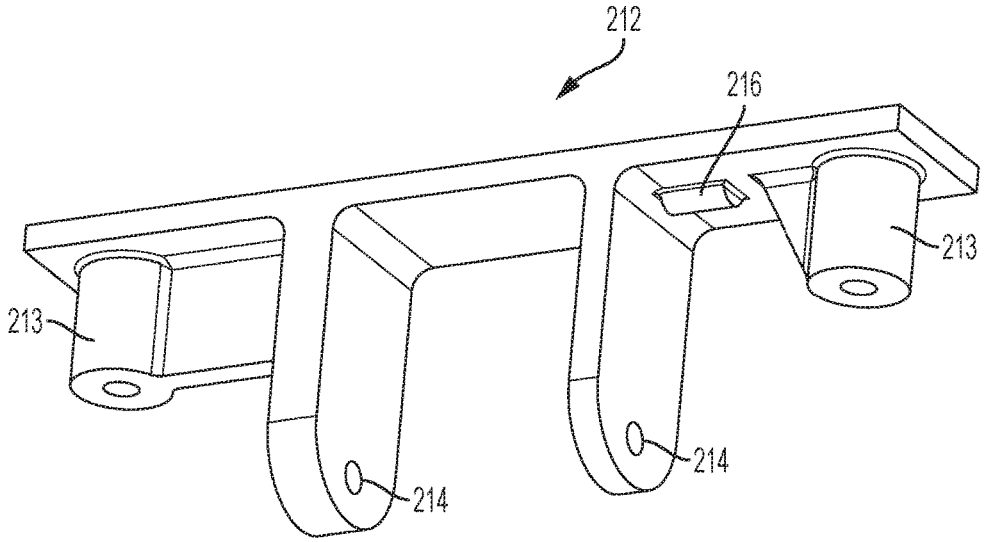
FIG. 37 illustrates an exemplary embodiment of a hinge support.
Figure 38:
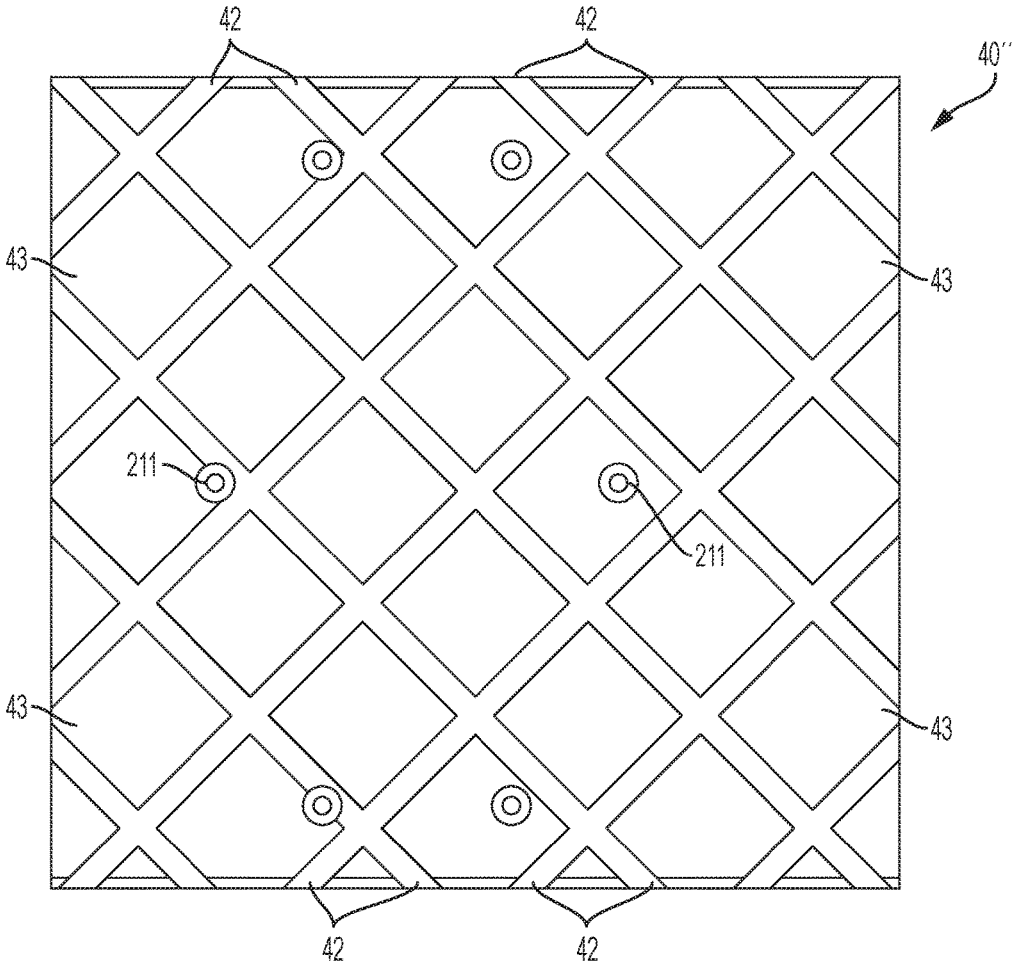
FIG. 38 illustrates an exemplary embodiment of a tray.
Figure 39:
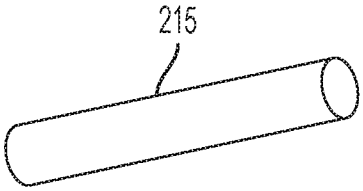
FIG. 39 illustrates an exemplary embodiment of a hinge.
Figure 40:
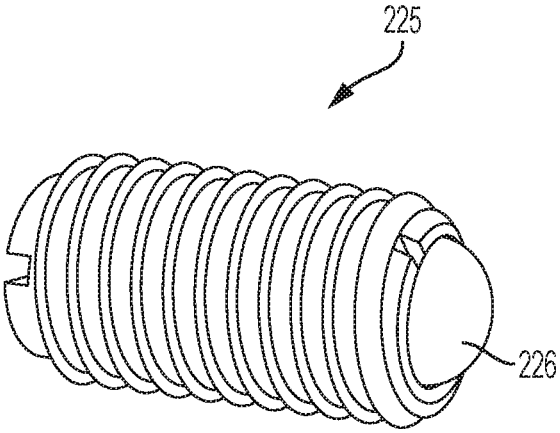
FIG. 40 illustrates an exemplary embodiment of a ball nose plunger.

The structure of this movable support will be described with respect to 35-41. As shown in FIG. 38, the sliding tray 40" includes a pair of screw holes 211. A hinge support 212, shown in FIG. 37, can be secured to the sliding tray 40" through the holes 211. As shown in FIG. 37, the hinge support 212 includes a pair of screw bosses 213. Screws can be inserted through these screw bosses 213 to secure the hinge support 212 in the sliding tray 40". A bump 216 is formed on the hinge support to cooperate with a portion of the movable support 210 in a manner discussed below. The hinge support 212 also includes supports 214 for a hinge pin 215, illustrated in FIG. 39.

Figure 35:
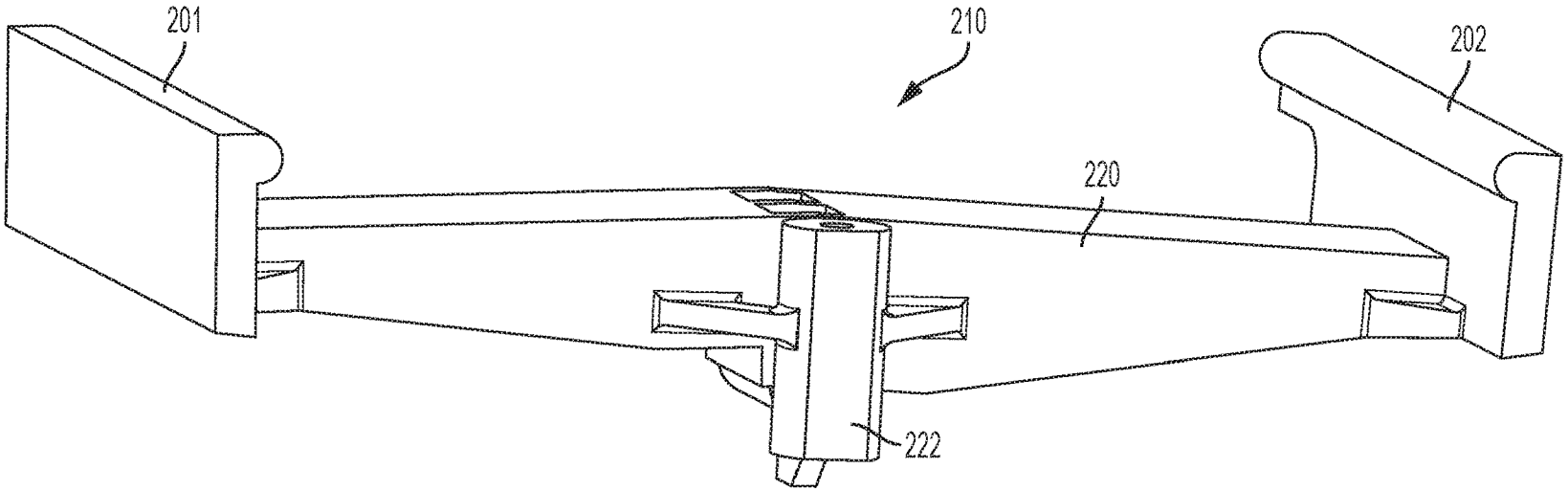
FIG. 35 illustrates an exemplary embodiment of a movable support.
Figure 36:
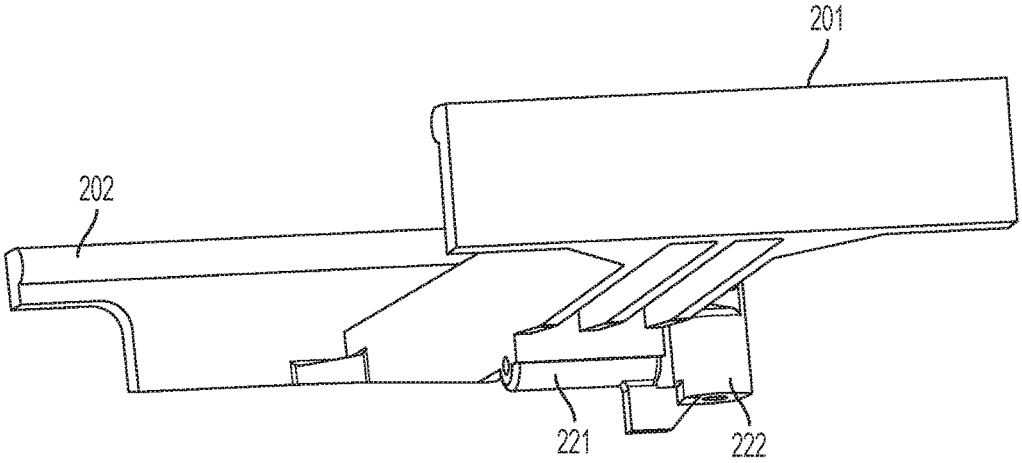
FIG. 36 illustrates another view of the exemplary embodiment of the movable support.

A movable support 210 is illustrated in FIGS. 35 and 36. The movable support 210 includes the previously discussed front tile support 201 and rear tile support 202. The front and rear tile supports 201, 202 are connected by a connecting part 220 which runs below tray 40". The movable support 210 includes a hinge pin support 221 through which it is connected to the hinge support 212. As will be appreciated, the hinge pin support 221 is disposed between the two supports 214 and the hinge pin 215 is slid through the supports 214 and the hinge pin support 221 to rotatably connect the parts. The movable support 210 also includes a ball nose plunger support 221. A ball nose plunger 225, shown in FIG. 40, can be screwed into the ball nose plunger support 222. The ball nose plunger 225 includes a ball 226 at its end that is biased by a spring.

Figure 41:
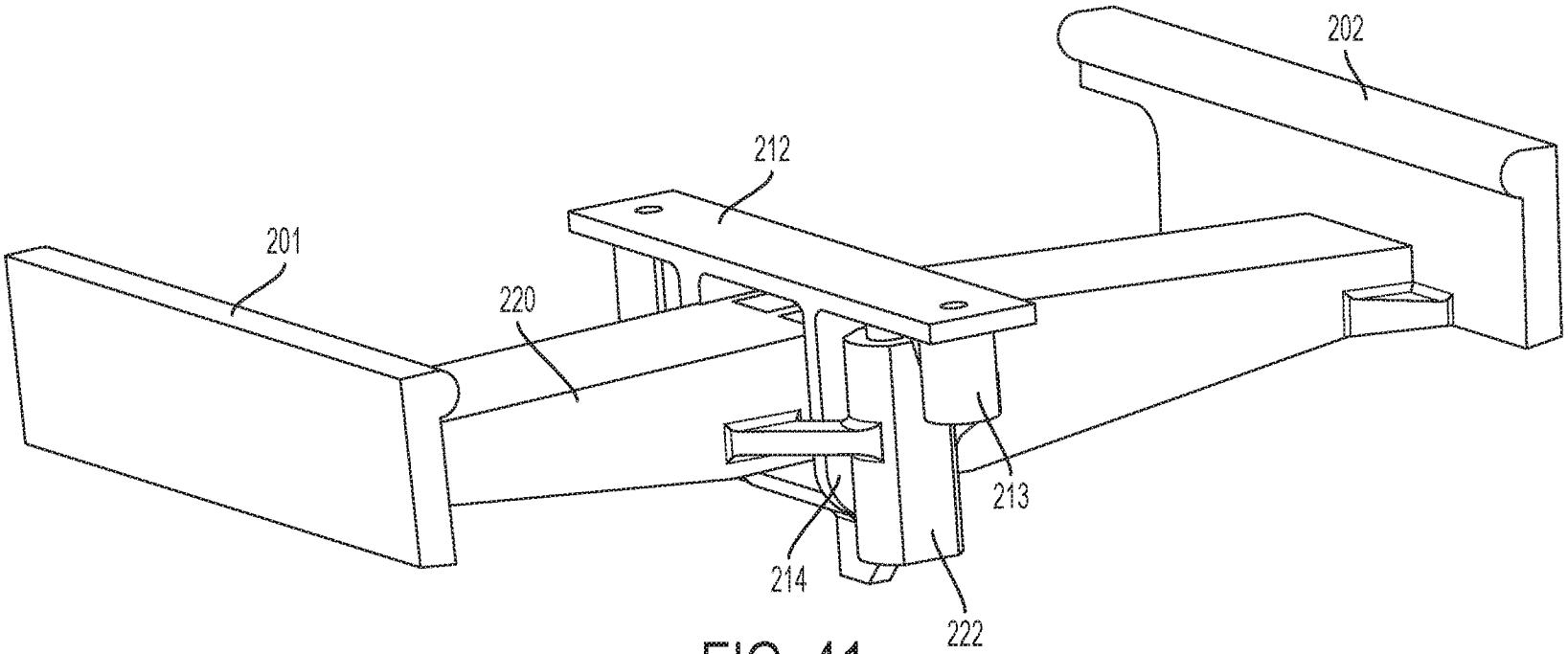
FIG. 41 illustrates an exemplary embodiment of an assembled movable support and hinge support.

FIG. 41 illustrates the movable support 210 connected with the hinge support 212. When assembled, the ball nose plunger support 222 which holds the ball nose plunger 225 lines up with the bump 216 on the hinge support 212. Because the ball 226 of the ball nose plunger 225 is biased outwardly, it is biased towards resting on either side of the bump 216 and resists moving across to the other side of the bump 216 unless moved by a user. Accordingly, when a user presses down on the front tile support 201, the movable support 210 will rotate about the hinge formed at the hinge pin 215 and the front tile support 201 will move lower. At the same time, this will rotate the rear tile support 202 higher into a position where it is above a top surface of the tray 40" and can serve as a support for a tile 200. Also at the same time, the ball 226 will be depressed into the ball nose plunger 225 to allow it to travel across the bump 216. After the ball 226 has travelled across the bump 216, it will spring back outwardly and secure the movable support in place. The movable support 210 can be moved back in the opposite manner. In particularly, a user can press down on the rear tile support 202 to move it out of the support position and the front tile support into the support position. The movable support 210 allows for alternatively front and rear tile supports through an attached piece that will not be lost by a user.

Another exemplary embodiment of a tile saw is shown in FIGS. 42-46. Features of tile saw 310 should be assumed to be the same as tile saw 10 unless otherwise shown or noted. Tile saw 310 includes a fixed table portion 331. The fixed table portion 331 is surrounded by a water collecting skirt 332. Also, the fixed table portion includes a patterned surface with grooves 333 which direct water into the skirt 332. The skirt may drain into the base 320.

In the tile saw 310 of this embodiment, there is a skirt 460 which is connected to and disposed around the sliding tray 440. As best seen in FIG. 44, the skirt 460 includes side edge portion 461 and front/rear edge portions 462. It also includes a drainage section 463. During use, water drains off of the sliding tray 440 into the skirt 460 or is directly splashed into the skirt 460. Once in the skirt 460, the water drains from the side edge portion 461 and the front/rear edge portions 462 into the drainage section 463 beneath the tray 440. The drainage section 463 includes a drainage hole 465 through which the water falls back into base 320 where it can be again used to cool the tile saw blade. The drainage hole 465 is generally centrally located on the sliding tray 440 so that it will always drain into base 320 and, in particular, the basin 321 (see FIG. 43). The basin 321 can be filled with water so that the blade 361 is cooled as the blade 361 rotates through the water. The basin 321 also includes a plugged hole 322. The plug (not shown) may be inserted to keep water in the basin 322 or removed to allows water to be drained from the basin 322. The skirt 460 may be designed such that the hole 465 is placed at the lowest elevation to promote water flow to the hole 465 from other parts of the skirt 460.

Figure 42:
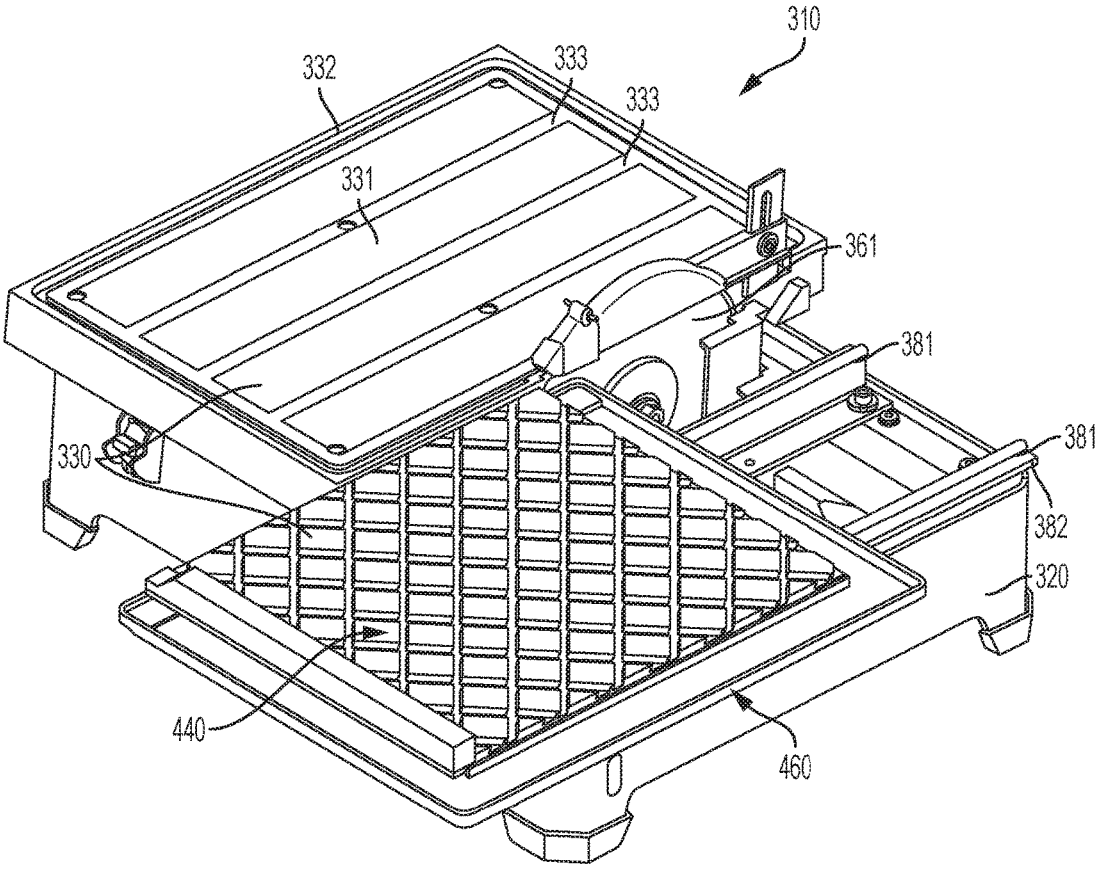
FIG. 42 illustrates another exemplary embodiment of a table tile saw, with a skirt attached to a sliding tray.
Figure 43:
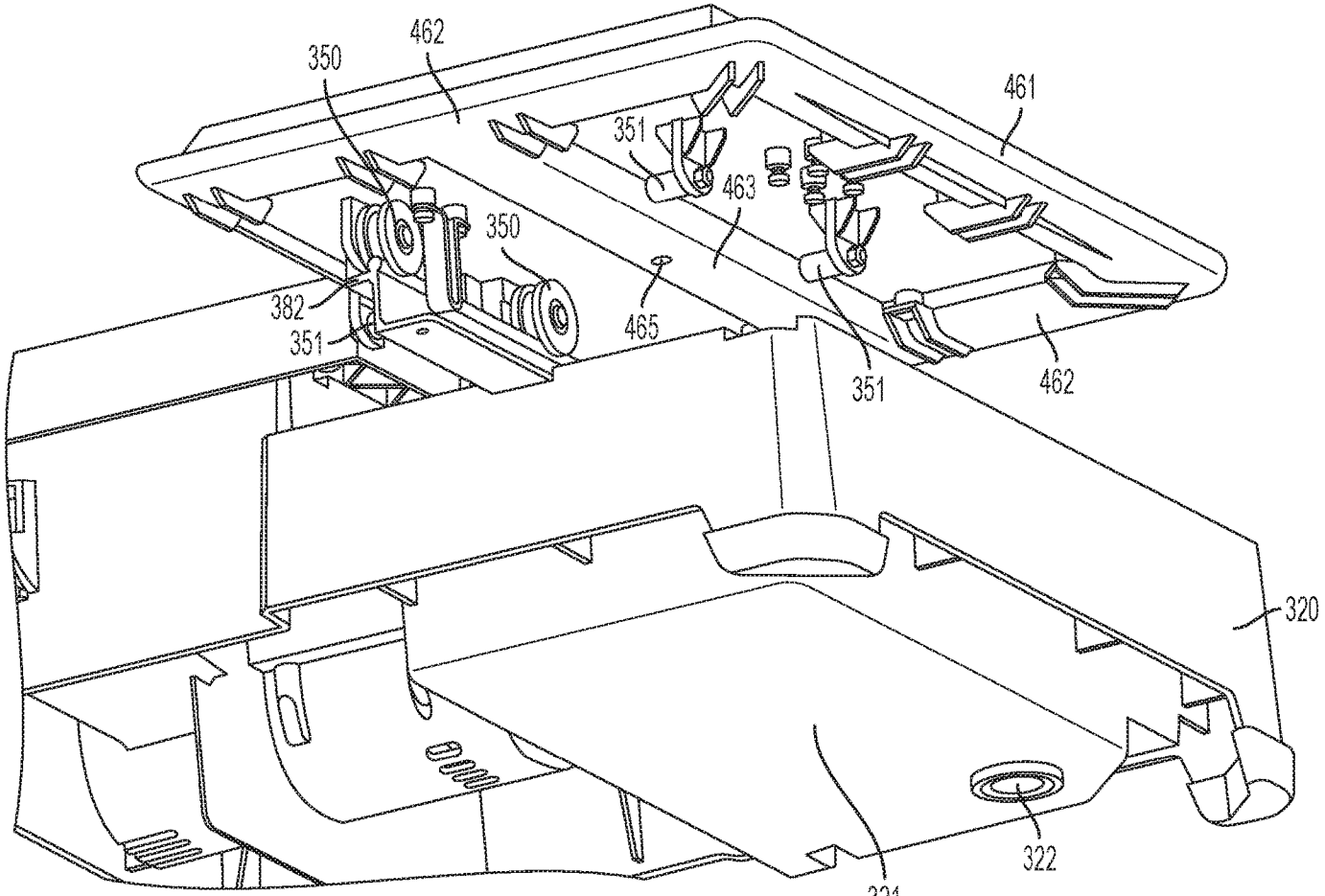
FIG. 43 illustrates a bottom perspective view of the exemplary embodiment of the table tile saw of FIG. 42.
Figure 44:
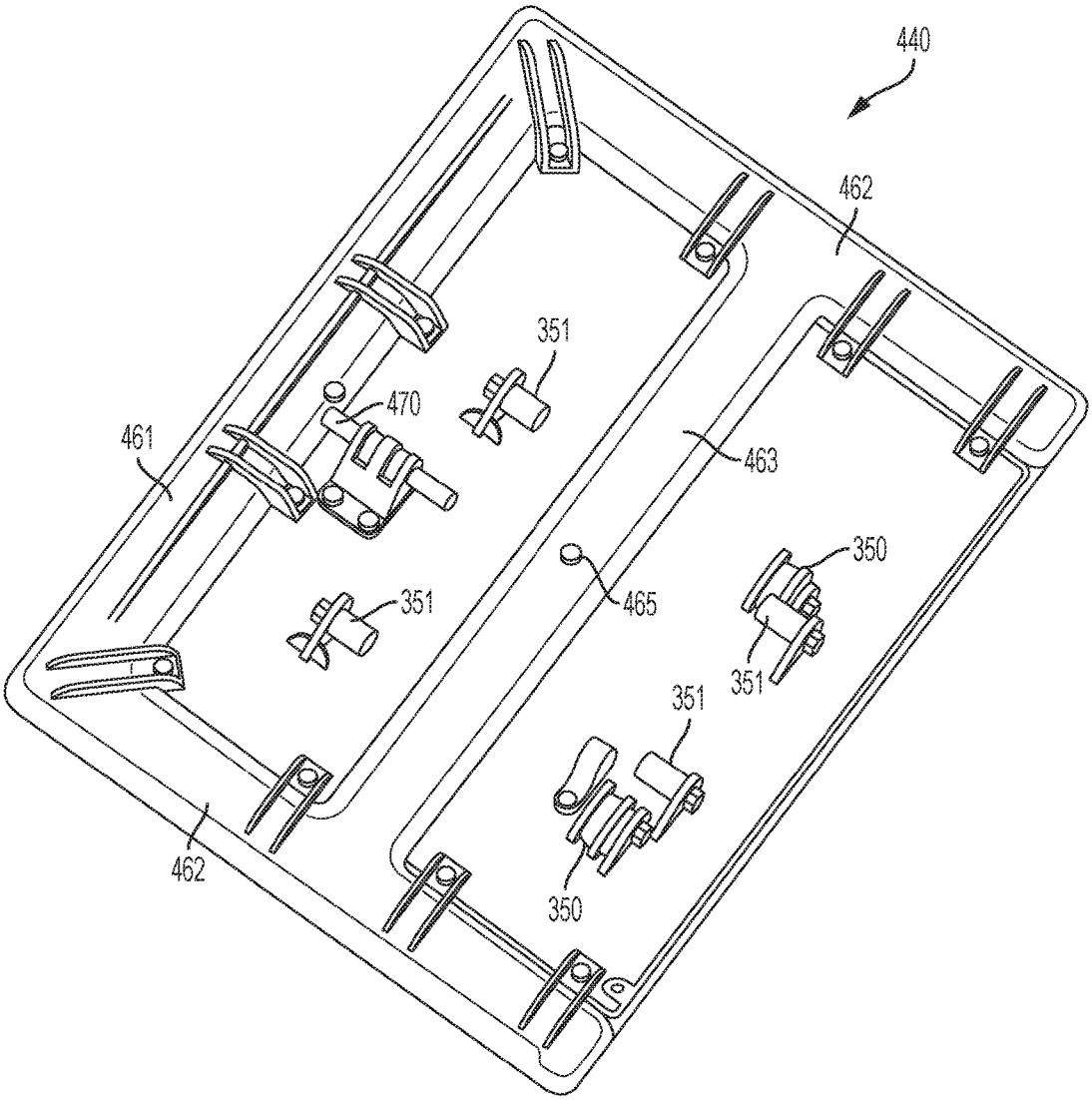
FIG. 44. illustrates a bottom view of the skirt of the exemplary embodiment of the table tile saw of FIG. 42.

As seen in FIGS. 42-44, the rail system of the tile saw 310 includes some differences from the previous embodiments. The tile saw 310 includes a pair of rails 381. The underside of the sliding tray 340 is shown in FIG. 44. As shown, the sliding tray includes two wheel rollers 350 and four support rollers 351. As can be seen in FIG. 43, the wheel rollers 350 roll on top of a rail 381 (only one rail 381 is shown in FIG. 43, the other being removed for viewing of other parts). The support rollers 351 fit beneath ledges 382 or other portions of the rails 381. In this embodiment, the sliding tray 440 can be removed from the remainder of the tile saw 310 by sliding the tray 440 completely off the rails 381 forward or backward. In other embodiments, there may be a stop at either or both ends of the rails 381 in order to prevent the tray 440 from sliding off. Additionally, the sliding tray 440 may be locked in place so that it does not slide. This may be particularly helpful during transport of the tile saw 310. An L-shaped lock bar 470 for locking the tray is shown in FIG. 44.

Figure 45:
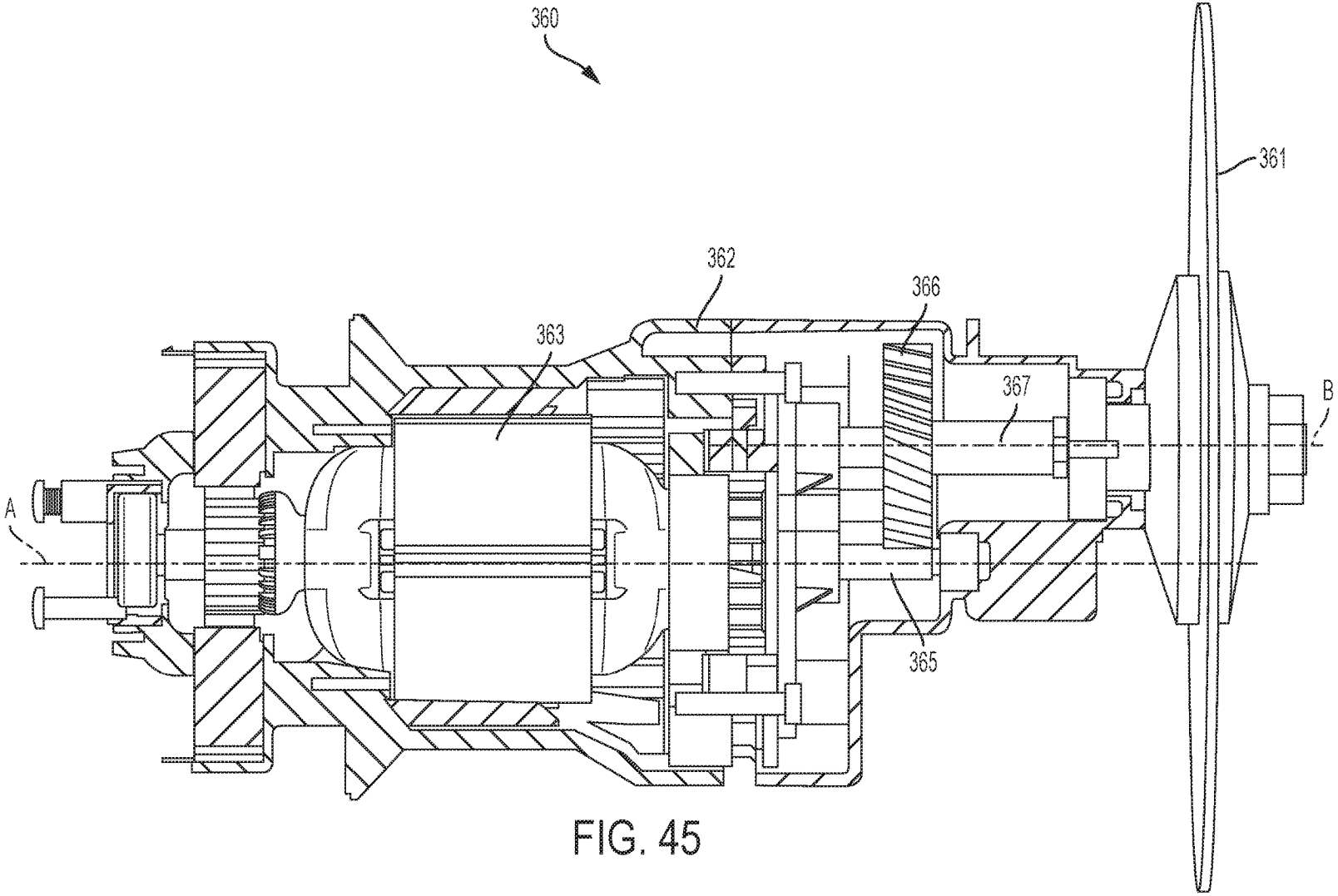
FIG. 45 illustrates an exemplary embodiment of a saw for a table tile saw.
Figure 46:
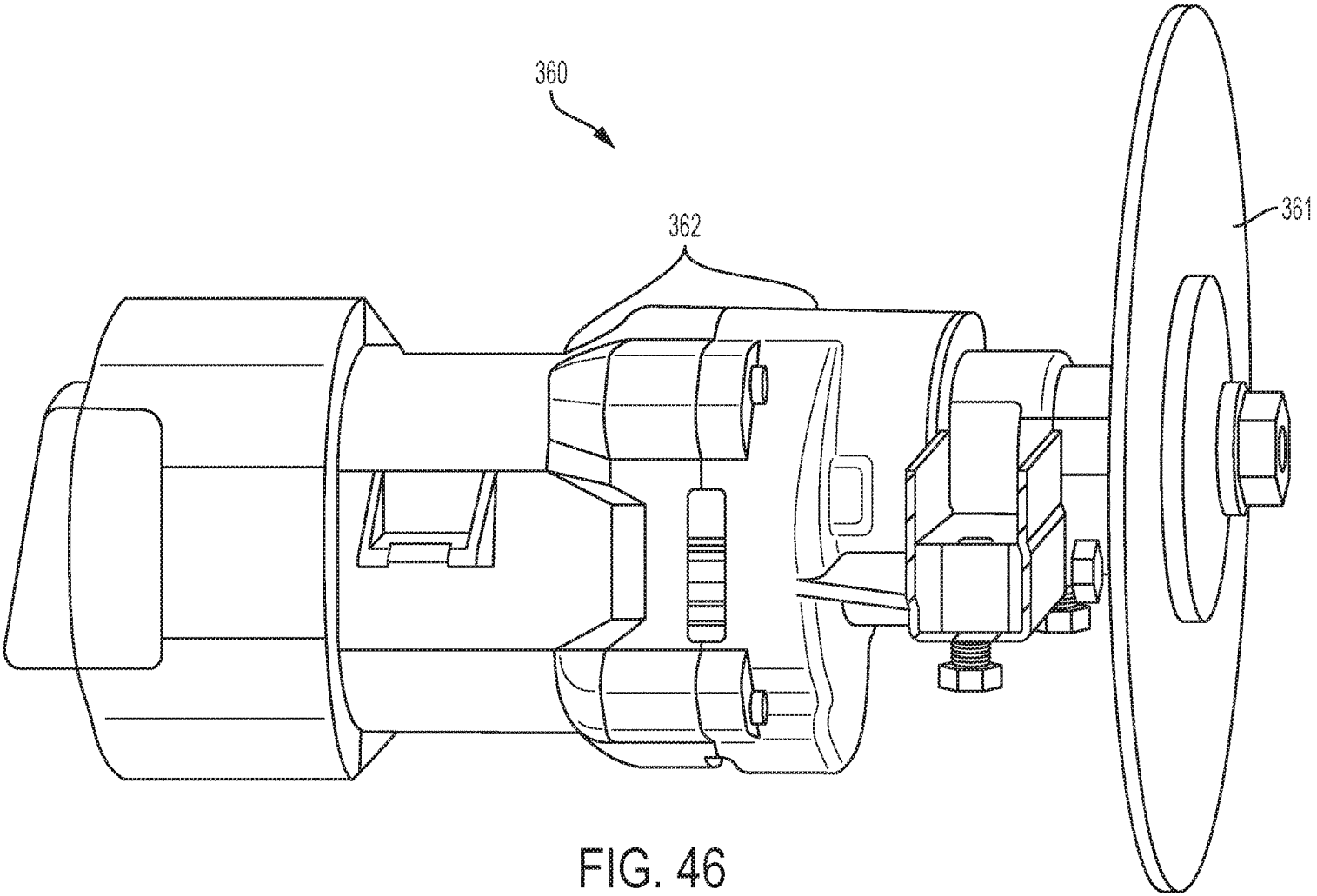
FIG. 46 illustrates a perspective view of the saw of FIG. 45.

A saw 360 for the tile saw 310 is shown in FIGS. 45 and 46. The saw 360 may be used in other embodiments of the tile saw. As shown in FIGS. 45 and 46, the blade 361 of saw 360 is offset upwardly from the axis of rotation of the motor 363. This allows a larger amount of the saw blade 361 to project above the table surface 330 (fixed table portion 331 and sliding tray 440).

As shown in FIGS. 45 and 46, the saw 360 includes a motor and transmission housing 362. A motor 363 is disposed within the housing 362 and may be a universal motor. The motor 363 may also include braking such that the motor slows down quickly when turned off. The motor 363 has an output shaft 365 which is driven by the motor 363. The output shaft 365 is geared and meshes with a gear 366 to drive the gear 366. The gear 366 has a tool driving shaft 367 which drives the saw blade 361. As can be seen, the saw blade 361 has an axis of rotation B which is offset from the axis of rotation A of the motor 363 so that the axis of rotation B of the saw blade 361 is closer to the table surface 330 than the axis of rotation A of the motor 363. The axes A and B are both parallel to a plane of the table surface 330 and the saw blade 361 is perpendicular to the plane of the table surface 330.

Figure 47:
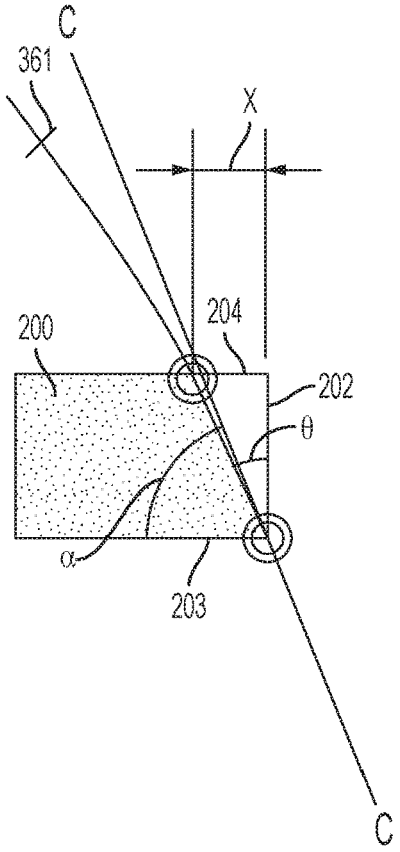
FIG. 47 illustrates an example tile cutting for an exemplary embodiment of a table tile saw.
Figure 48:
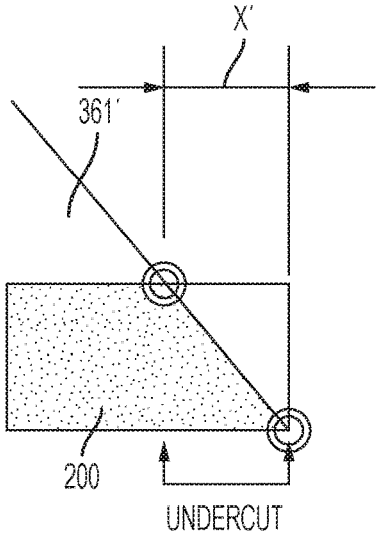
FIG. 48 illustrates a comparative example of a tile cutting.

As noted above, the offset blade 361 allows more of the blade 361 to be above a surface of the table 330. This creates a better cut, as will be described with reference to FIGS. 47 and 48. FIG. 47 shows the exemplary embodiment of the present embodiment with the offset blade 361. FIG. 48 shows a comparative example. FIG. 47 shows a tile 200 being cut by saw blade 361. The tile 200 has a trailing edge 202 which is the last part of the tile 200 to be cut. A bottom part 203 of the tile 200 is cut before the blade 361 reaches the trailing edge at a top 204 of the tile 200. This creates an undercut X. The greater the undercut, the more likely that the tile 200 chips. A higher blade 361 allows a part of the blade 361 which is closer to vertical than is otherwise possible. That is, the angle $\theta$ between vertical and the blade 361 at a position where it extends from the table surface 330 is reduced. The angle $\theta$ may be 40 degrees or less; 35 degrees or less; 30 degrees or less; 25 degrees or less; 20 degrees or less; 15 degrees or less; 10 degrees or less; or 5 degrees or less. The angle $\alpha$ is the angle between the table surface 330 and the edge of the saw blade 361 and is complementary to the angle $\theta$. The angle $\alpha$ may be 50 degrees or greater; 55 degrees or greater; 60 degrees or greater; 65 degrees or greater; 70 degrees or greater; 75 degrees or greater; 80 degrees or greater; or 85 degrees or greater. The outer edge of the blade 361 is curved. As noted above, the angles $\theta$ and $\alpha$ are taken at the point where the edge of the blade 361 projects from the table surface 330. Thus, the angle $\theta$ is an angle between vertical and a tangent C of the edge of the blade where it projects from the table surface 330 and the angle $\alpha$ is an angle between the table surface and tangent C.

As will be appreciated, the particular amount of undercut X will be influenced by not only the positioning and size of the blade 361, but also the thickness of the tile being cut.

A comparative example is shown in FIG. 48. The example shown in FIG. 48 shows a blade 361' that is not offset. The blade 361' cuts the tile 200 with a portion more near the top of the blade 361' than in the exemplary embodiment of FIG. 47. This creates a larger angle θ' and a larger under cut X' which is more likely to result in a chipped tile 200 as compared to the exemplary embodiment of FIG. 48.

In addition to reducing chipping of the tile 200, the offset axis of rotation of the saw blade 361 may also have additional advantages. For example, having a greater amount of the saw blade 361 above the tray 440 uses less water. Additionally, because the length of the cutting edge of the blade 361 which is cutting tile 200 is reduced, runtime of the tile saw 310 is improved when using a battery powered tile saw.

Various embodiments have been described above. It will be appreciated that features of the various embodiments may be combined and such combinations are contemplated by this application. For example, the rotatable tray of FIGS. 19-22 can be used with any of the various support systems shown and described in this application. Additionally, the offset saw blade arrangement described with respect to FIGS. 42-48 may be used with other embodiments.

The exemplary embodiments have been shown and described with respect to a tile saw. However, various features of the present application may not be limited to tile saws.

While the invention has been described by way of exemplary embodiments, it is understood that the words which have been used herein are words of description, rather than words of limitation. Changes may be made within the purview of the appended claims, without departing from the scope and spirit of the invention in its broader aspects.

What is claimed is:

1. A cutting device, comprising:

a stand;

a saw supported by the stand, the saw including a motor and a blade configured to be rotatably driven by the motor when the motor is on;

a tray, the tray including an upper surface, the upper surface being configured to support an object to be cut, and the tray being slidable with respect to the saw;

a basin configured to hold water, wherein part of the blade is configured to rotate through the basin when the blade is driven by the motor;

wherein the motor has an axis of rotation of the motor;

wherein the blade has an axis of rotation of the blade;

wherein the axis of rotation of the blade is offset from the axis of rotation of the motor;

wherein the axis of rotation of the motor is disposed below a plane of the upper surface of the tray;

further comprising a motor and transmission housing which houses the motor and a transmission;

wherein the transmission includes a tool driving shaft which rotates about the axis of rotation of the blade;

wherein the tray is slidable along a first axis;

wherein the tray has a tray length along the first axis;

wherein the basin has a basin length along the first axis;

wherein the basin length is longer than the tray length;

further comprising a rail on which the tray is slidable;

further comprising a roller which facilitates the tray sliding on the rail;

wherein the rail extends parallel to the first axis;

wherein the tray has first and second sides parallel to the first axis; and wherein the rail is disposed away from the first and second sides of the tray.

2. The cutting device of claim 1, wherein the axis of rotation of the blade is parallel to the axis of rotation of the motor.

3. The cutting device of claim 2, wherein the axis of rotation of the blade is parallel to the plane of the upper surface of the tray.

4. The cutting device of claim 3, wherein the axis of rotation of the blade is closer to the plane of the upper surface of the tray than the axis of rotation of the motor is to the plane of the upper surface of the tray.

5. The cutting device of claim 4, wherein there is a tangent fine C of an outer edge of the blade taken where the outer edge of the blade meets the plane of the upper surface of the tray; and wherein an angle α between a portion of the plane of the upper surface of the tray running through the blade and the tangent line C is 50 degrees or greater.

6. The cutting device of claim 5, wherein the angle α is 55 degrees or greater.

7. The cutting device of claim 5, wherein the angle α is 60 degrees or greater.

8. The cutting device of claim 1, further comprising a fixed table surface supported by the stand.

9. The cutting device of claim 8, wherein the blade is disposed between the fixed table surface and the tray.

10. The cutting device of claim 1, wherein the transmission includes at least one gear.

11. The cutting device of claim 10, further comprising a fixed table surface, and wherein the motor is disposed below the fixed table surface.

12. The cutting device of claim 11, wherein the fixed table surface is disposed adjacent to the tray.

13. The cutting device of claim 1, wherein the basin has a basin upper surface defining an outer edge of the basin; and wherein the rail sits at least partially below the basin upper surface.

14. A cutting device, comprising:

a stand;

a saw supported by the stand, the saw including a motor and a blade configured to be rotatably driven by the motor when the motor is on;

a tray, the tray including an upper surface, the upper surface being configured to support an object to be cut, and the tray being slidable with respect to the saw and the stand;

a basin configured to hold water, wherein part of the blade is configured to rotate through the basin when the blade is driven by the motor;

wherein there is a tangent line C of an outer edge of the blade taken where the outer edge of the blade meets a plane of an upper surface of the tray; and wherein an angle α between a portion of the plane of the upper surface of the tray running through the blade and the tangent line C is 50 degrees or greater;

further comprising a housing and a gear;

wherein the motor and the gear are housed in the housing;

wherein the motor has an output shaft which is operatively coupled to the gear;

wherein the tray is slidable along a sliding axis;

wherein the basin has a greater length along the sliding axis than the tray;

further comprising a rail on which the tray is slidable;

further comprising a roller which facilitates the tray sliding on the rail;

wherein the rail extends parallel to the sliding axis;

wherein the tray has first and second sides parallel to the sliding axis; and wherein the rail is disposed away from the first and second sides of the tray.

15. The cutting device of claim 14, wherein the angle α is 55 degrees or greater.

16. The cutting device of claim 14, wherein the angle α is 60 degrees or greater.

17. The cutting device of claim 14, wherein the motor has an axis of rotation of the motor;

wherein the blade has an axis of rotation of the blade;

wherein the axis of rotation of the blade is offset from the axis of rotation of the motor; and wherein the axis of rotation of the motor is disposed below the plane of the upper surface of the tray;

wherein an axis of rotation of the blade is parallel to the plane of the upper surface of the tray;

wherein the axis of rotation of the blade is closer to the plane of the upper surface of the tray than the axis of rotation of the motor is to the plane of the upper surface of the tray;

wherein the cutting device further comprises a fixed table surface supported by the stand; and wherein the blade is disposed between the fixed table surface and the tray.

18. A cutting device, comprising:

a stand;

a saw supported by the stand, the saw including a motor and a blade configured to be rotatably driven by the motor when the motor is on;

a tray, the tray including a tray upper surface, the tray upper surface being configured to support an object to be cut, and the tray being slidable along a first axis;

a basin configured to hold water, wherein part of the blade is configured to rotate through the basin when the blade is driven by the motor;

wherein the tray upper surface has a tray upper surface length along the first axis;

wherein the basin has a basin length along the first axis;

wherein the basin length is longer than the tray upper surface length;

further comprising a fixed table surface, and wherein the motor is disposed below the fixed table surface;

wherein the fixed table surface has a table upper surface;

wherein the tray upper surface and the table upper surface are in substantially the same plane;

further comprising a rail on which the tray is slidable; and further comprising a roller which facilitates the tray sliding on the rail.

19. The cutting device of claim 18, wherein the fixed table surface is disposed adjacent to the tray.

* * * * *